US010173432B2

(12) United States Patent
Okumura et al.

(10) Patent No.: US 10,173,432 B2
(45) Date of Patent: Jan. 8, 2019

(54) PRINTER

(71) Applicant: SEIKO EPSON CORPORATION, Tokyo (JP)

(72) Inventors: Hideki Okumura, Shiojiri (JP); Shoma Kudo, Shiojiri (JP); Naomi Kimura, Okaya (JP); Motoyoshi Shirotori, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/905,072

(22) Filed: Feb. 26, 2018

(65) Prior Publication Data

US 2018/0244052 A1 Aug. 30, 2018

(30) Foreign Application Priority Data

Feb. 28, 2017 (JP) ..... 2017-035975

(51) Int. Cl.

*B41J 2/175* (2006.01)
*B41J 13/10* (2006.01)
*B41J 2/165* (2006.01)

(52) U.S. Cl.

CPC ..... *B41J 2/1752* (2013.01); *B41J 2/16508* (2013.01); *B41J 2/17553* (2013.01); *B41J 13/106* (2013.01); *B41J 2202/15* (2013.01)

(58) Field of Classification Search

CPC .. B41J 2/1752; B41J 2/17553; B41J 2/16508; B41J 2/175; B41J 2/17503; B41J 2/17509; B41J 13/106

See application file for complete search history.

(56) References Cited

U.S. PATENT DOCUMENTS

| | | | | |
|---|---|---|---|---|
| 5,686,947 | A | 11/1997 | Murray et al. | |
| 6,565,197 | B1 | 5/2003 | Murray et al. | |
| 9,302,516 | B2 * | 4/2016 | Osakabe | B41J 2/17513 |
| 2013/0169720 | A1 | 7/2013 | Nakamura et al. | |
| 2015/0283832 | A1 | 10/2015 | Osakabe et al. | |
| 2016/0176194 | A1 | 6/2016 | Osakabe et al. | |
| 2016/0221348 | A1 | 8/2016 | Nakamura et al. | |
| 2017/0246872 | A1 | 8/2017 | Osakabe et al. | |

FOREIGN PATENT DOCUMENTS

| | | | |
|---|---|---|---|
| JP | H11-504874 | A | 5/1999 |
| JP | 2013-139140 | A | 7/2013 |
| JP | 2015-199264 | A | 11/2015 |

* cited by examiner

*Primary Examiner* — Juanita D Jackson
(74) *Attorney, Agent, or Firm* — Foley & Lardner LLP

(57) ABSTRACT

A decrease in the capacity of an ink tank can be easily avoided while downsizing a printer. A printer includes a printing head, an ink tank, a carriage provided with the printing head movable back and forth, and a medium conveyance device that conveys a printing medium on a conveyance path intersecting the carriage moving direction. An axis line along the carriage moving direction is an X axis and an axis line orthogonal to the X axis is a Y axis, an axis line orthogonal to the X and Y axises is defined as a Z axis. When viewed along the Z axis, the ink tank is located in a region outside a movable region of the carriage along the Y axis, and is arranged so as to extend across a region outside the conveyance path along the X axis and a region that is overlapped with the conveyance path.

8 Claims, 17 Drawing Sheets

PRINTER

CROSS REFERENCE TO RELATED APPLICATIONS

The present application claims priority from Japanese Patent Application No. 2017-035975 filed on Feb. 28, 2017, the contents of which are hereby incorporated by reference into this application.

BACKGROUND

1. Technical Field

The present invention relates to printers and the like.

2. Related Art

Examples of hitherto known printers include inkjet printers. In an inkjet printer, printing on a printing medium such as printing paper can be carried out by discharging ink, which is one example of a liquid, from a printing head onto the printing medium. Some such inkjet printers include a liquid container such as an ink tank that can contain ink to be supplied to the printing head. An inlet port is formed in the ink tank, and an operator can inject new ink into the ink tank from the inlet port. A configuration of such an inkjet printer is hitherto known in which at least a portion of the ink tank is arranged between both ends of a moving region of a carriage in a left and right direction (JP-A-2015-199264, for example).

If a configuration is adopted, in the inkjet printer described in JP-A-2015-199264, in which the entirety of the ink tank is arranged between both ends of the moving region of the carriage in the left and right direction, further downsizing can be realized. However, in this configuration, because the arrangement region of the ink tank is restricted, the size of the ink tank is limited. Therefore, in this configuration, it is difficult to increase the volume of ink that can be contained in the ink tank, for example.

SUMMARY

An advantage of some aspects of the invention is that a decrease in the capacity of the ink tank can be easily avoided while downsizing the printer.

The invention is realized as the following embodiments and application examples.

Application Example 1

A printer including: a printing head that can eject ink toward a printing medium; an ink tank that includes an ink container that can contain the ink that is to be supplied to the printing head and an ink inlet port through which the ink can be injected into the ink container; a carriage in which the printing head is mounted and that can move back and forth in a state in which the printing head is mounted; and a medium conveyance device that conveys the printing medium on a conveyance path that intersects a moving direction of the carriage. An axis line along the moving direction of the carriage is defined as an X axis and an axis line orthogonal to the X axis is defined as a Y axis, an axis line orthogonal to the X axis and the Y axis is defined as a Z axis. The ink tank, when viewed along the Z axis, is located in a region outside a movable region of the carriage along the Y axis, and is arranged so as to extend across a region outside the conveyance path along the X axis and a region that is overlapped with the conveyance path. Furthermore, the ink tank, when viewed along the Y axis, includes a part overlapped with the movable region of the carriage.

In this printer, when an axis line along a moving direction of the carriage is defined as an X axis and an axis line orthogonal to the X axis is defined as a Y axis, when viewed along the Z axis, the ink tank is located in a region outside the movable region of the carriage along the Y axis. Accordingly, it is possible to avoid a case in which the ink tank protrudes from the movable region of the carriage in a direction along the X axis. Also, when viewed along the Z axis, the ink tank is arranged so as to extend across a region outside the conveyance path along the X axis and a region that is overlapped with the conveyance path. Accordingly, the ink tank can be extended to a region that is overlapped with the conveyance path. Therefore, according to this printer, a decrease in the capacity of the ink tank can be easily avoided while downsizing the printer.

Application Example 2

The printer described above, further including: a discharge port from which the printing medium on which printing has been performed is discharged; and a cap that can cover the printing head. A direction from an intersection region in which the movable region of the carriage intersects the conveyance path toward the discharge port is defined as a +Y axis direction, and a direction from the intersection region toward the cap is defined as a +X axis direction, when viewed along a −Z axis direction defined as an ink ejection direction of the printing head. The region that is outside the movable region of the carriage along the Y axis and is outside the conveyance path along the X axis is located on the +X axis direction side relative to the conveyance path and on the +Y axis direction side relative to the movable region of the carriage.

In this printer, the ink tank is arranged so as to extend across a region that is located on the +X axis direction side relative to the conveyance path and on the +Y axis direction side relative to the movable region of the carriage, and a region that is overlapped with the conveyance path. Accordingly, the ink tank can be extended to a region that is overlapped with the conveyance path.

Application Example 3

The printer described above, further including: a discharge port from which the printing medium on which printing has been performed is discharged; and a cap that can cover the printing head. A direction from an intersection region in which the movable region of the carriage intersects the conveyance path toward the discharge port is defined as a +Y axis direction, and a direction from the intersection region toward the cap is defined as a +X axis direction, when viewed in a −Z axis direction defined as an ink ejection direction of the printing head. The region that is outside the movable region of the carriage along the Y axis and is outside the conveyance path along the X axis is located on a −X axis direction side relative to the conveyance path and on a +Y axis direction side relative to the movable region of the carriage.

In this printer, the ink tank is arranged so as to extend across a region that is located on the −X axis direction side relative to the conveyance path and on the +Y axis direction side relative to the movable region of the carriage, and a region that is overlapped with the conveyance path. Accordingly, the ink tank can be extended to a region that is overlapped with the conveyance path.

Application Example 4

The printer described above, further including: a discharge port from which the printing medium on which printing has been performed is discharged; and a cap that can cover the printing head. A direction from an intersection region in which the movable region of the carriage intersects the conveyance path toward the discharge port is defined as a +Y axis direction, and a direction from the intersection region toward the cap is defined as a +X-axis direction, when viewed in a −Z axis direction defined as an ink ejection direction of the printing head. The region that is outside the movable region of the carriage along the Y axis and is outside the conveyance path along the X axis is located on a +X axis direction side relative to the conveyance path and on a −Y axis direction side relative to the movable region of the carriage.

In this printer, the ink tank is arranged so as to extend across a region that is located on the +X axis direction side relative to the conveyance path and on the −Y axis direction side relative to the movable region of the carriage, and a region that is overlapped with the conveyance path. Accordingly, the ink tank can be extended to a region that is overlapped with the conveyance path.

Application Example 5

The printer described above, further including: a discharge port from which the printing medium on which printing has been performed is discharged; and a cap that can cover the printing head. A direction from an intersection region in which the movable region of the carriage intersects the conveyance path toward the discharge port is defined as a +Y axis direction, and a direction from the intersection region toward the cap is defined as a +X axis direction, when viewed in a −Z axis direction defined as an ink ejection direction of the printing head. The region that is outside the movable region of the carriage along the Y axis and is outside the conveyance path along the X axis is located on a −X axis direction side relative to the conveyance path and on a −Y axis direction side relative to the movable region of the carriage.

In this printer, the ink tank is arranged so as to extend across a region that is located on the −X axis direction side relative to the conveyance path and on the −Y axis direction side relative to the movable region of the carriage, and a region that is overlapped with the conveyance path. Accordingly, the ink tank can be extended to a region that is overlapped with the conveyance path.

Application Example 6

The printer described above, wherein, when an ink ejection direction of the printing head is defined as a −Z axis direction, and a direction opposite to the −Z axis direction is defined as a +Z axis direction, a portion of the ink tank that is located in a region that is overlapped with the conveyance path, when viewed in the −Z axis direction, is located on a +Z axis direction side relative to the conveyance path.

In this printer, a portion of the ink tank that is located in a region that is overlapped with the conveyance path, when viewed in the −Z axis direction, can be overlaid over the conveyance path at a position on the +Z axis direction side relative to the conveyance path.

Application Example 7

The printer described above, wherein, when an ink ejection direction of the printing head is defined as a −Z axis, and a direction opposite to the −Z axis direction is defined as a +Z axis direction, a portion of the ink tank that is located in a region that is overlapped with the conveyance path, when viewed in the −Z axis direction, is located on the −Z axis direction side relative to the conveyance path.

In this printer, when the −Z axis direction is a gravity direction, since a portion of the ink tank that is located in a region that is overlapped with the conveyance path, when viewed in the −Z axis direction, is located below the conveyance path, it is possible to avoid the dripping of ink onto the conveyance path when ink drips from the ink tank.

Application Example 8

The printer described above, further including a plurality of the ink tanks, wherein at least one ink tank out of the plurality of ink tanks is arranged so as to extend across a region outside the conveyance path along the X axis and a region that is overlapped with the conveyance path, when viewed along the Z axis.

In this printer, at least one ink tank out of the plurality of ink tanks can be extended to a region that is overlapped with the conveyance path.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
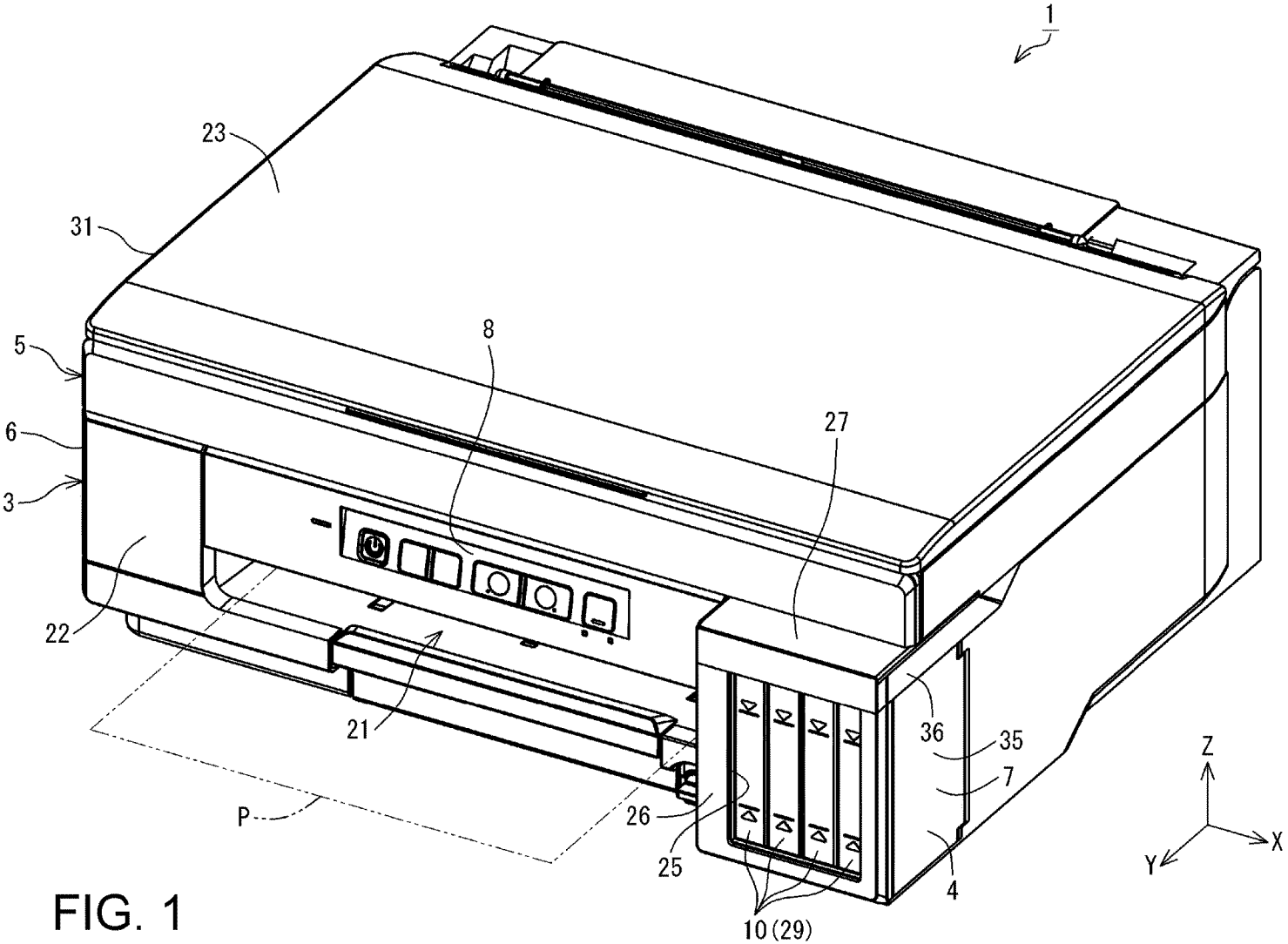
FIG. 1 is a perspective view illustrating a main configuration of a printer in a present embodiment.

An embodiment will be described with reference to the drawings. Note that, in the drawings, the scale of constituent parts and members may be different such that the respective constituent parts are shown with a recognizable size.

A printer 1 in the present embodiment includes a printing unit 3, which is an example of a liquid ejection device, a tank unit 4, and a scanner unit 5, as shown in FIG. 1. The printing unit 3 includes a housing 6. The housing 6 constitutes an outer shell of the printing unit 3. A mechanism unit (described later) of the printing unit 3 is housed inside the housing 6. The tank unit 4 includes a housing 7 and a plurality of (two or more) ink tanks 10. The plurality of ink tanks 10 are housed in the housing 7. Accordingly, the plurality of ink tanks 10 are provided next to or in the printing unit 3. Note that, four ink tanks 10 are provided in the present embodiment.

The housing 6, the housing 7, and the scanner unit 5 constitute the outer shell of the printer 1. Note that a configuration in which the scanner unit 5 is omitted can be adopted as the printer 1. The printer 1 can perform printing on a printing medium P such as printing paper with ink, which is an example of liquid. The printing medium P is an example of a medium on which printing is performed. Note that the ink tank 10 is an example of a liquid container. Note that the housing 6 includes a panel 8. A power button, an operation button, a display device, and the like are arranged in the panel 8. Note that the number of ink tanks 10 is not limited to two or more, and may be one.

Here, X, Y, and Z axes, which are coordinate axes that are orthogonal to each other, are provided in FIG. 1. The X, Y, and Z axes are also provided as required in the subsequent drawings. In this case, the X, Y, and Z axes in each diagram correspond respectively to the X, Y, and Z axes in FIG. 1. FIG. 1 shows a state where the printer 1 is arranged on an XY plane defined by the X axis and the Y axis. In this embodiment, the state where the printer 1 is arranged on the XY plane with the XY plane being matched to a horizontal plane is a use state of the printer 1. The posture of the printer 1 when the printer 1 is arranged on the XY plane that matches a horizontal plane will be referred to as a use posture of the printer 1.

Hereinafter, the X axis, Y axis, and Z axis that appear in the drawings and descriptions depicting constituent parts and units of the printer 1 mean the X axis, Y axis, and Z axis in a state in which the constituent parts and units are assembled in (mounted in) the printer 1. The posture of the constituent parts and units when the printer 1 is in the use state will be referred to as a use posture of these constituent parts and units. In the following description, the printer 1, the constituent parts and units thereof, and the like are described as being in their use posture, unless otherwise stated.

The Z axis is an axis perpendicular to the XY plane. When the printer 1 is in the use state, the Z axis direction is a vertically upward direction. Also, when the printer 1 is in the use state, the −Z axis direction is a vertically downward direction in FIG. 1. Note that, regarding the X, Y, and Z axes, the arrow orientation indicates a plus (positive) direction, and the orientation opposite to the arrow orientation indicates a minus (negative) direction. Note that the four ink tanks 10 described above are arranged side by side along the X axis. Therefore, the X axis direction can also be defined as the direction in which the four ink tanks 10 are arranged. Also, the vertically upward direction and vertically upward indicate an upward direction and upward along a vertical line. Similarly, the vertically downward direction and vertically downward indicate a downward direction and downward along a vertical line. The upward direction and upward without mentioning "vertically" are not limited to an upward direction and upward along a vertical line, and include an upward direction and upward along a direction that intersects the vertical line except for the horizontal direction. Also, the downward direction and downward without mentioning "vertically" are not limited to a downward direction and downward along a vertical line, and include a downward direction and downward along a direction that intersects the vertical line except for the horizontal direction. That is, the upward direction and upward indicate a direction that includes a component in the vertically upward direction among directions that intersect the vertical line. Similarly, the downward direction and downward indicate a direction that includes a component in the vertically downward direction among directions that intersect the vertical line.

The printing unit 3 is provided with a discharge port 21. In the printing unit 3, a printing medium P is discharged from the discharge port 21. In the printing unit 3, the face in which the discharge port 21 is provided is a front face 22. Note that a panel 8 is arranged in the front face 22, in the printer 1. The panel 8 faces in the same direction as the front face 22 (Y axis direction, in the present embodiment). The front face 22 of the printing unit 3 and the front face 22 of the scanner unit 5 are located on the same flat plane. That is, the front face 22 of the printer 1 includes the front face 22 of the printing unit 3 and the front face 22 of the scanner unit 5. Also, the panel 8 and the front face 22 of the printing unit 3 are located on the same flat plane.

In the printer 1, a face, of the scanner unit 5, that faces vertically upward is an upper face 23. The tank unit 4 is provided in the front face 22 of the printing unit 3. The housing 7 is provided with a window portion 25. The window portion 25 is provided in a front face 26, in the housing 7. Here, the front face 26 of the tank unit 4 faces in the same direction as the front face 22 of the printing unit 3 (Y axis direction, in the present embodiment). The tank unit 4 protrudes in the Y axis direction from the front face 22. Accordingly, the housing 7 of the tank unit 4 protrudes in the Y axis direction from the front face 22. Therefore, the front face 26 of the tank unit 4 is located on the Y axis direction side relative to the front face 22 of the printing unit 3.

Also, an upper face 27 of the tank unit 4 is located on a −Z axis direction side relative to the upper face 23 of the printing unit 3. When the printer 1 is viewed in plan view in the −Z axis direction, the scanner unit 5 is overlapped with a portion of the tank unit 4. The scanner unit 5 is located on the Z axis direction side relative to the upper face 27 of the tank unit 4. A portion of the upper face 27 of the tank unit 4 is covered by the scanner unit 5.

In the tank unit 4, the window portion 25 is optically transparent. The four ink tanks 10 described above are provided at positions so as to be overlapped with the window portion 25. Each ink tank 10 is provided with an ink container 29. In each ink tank 10, ink is contained in the ink container 29. The window portion 25 is provided at a position so as to overlap the ink containers 29 of the ink tanks 10. Accordingly, an operator that uses the printer 1 can view the ink container 29 of each of the four ink tanks 10 in the housing 7 using the window portion 25. In the present embodiment, the window portion 25 is provided as an opening formed in the housing 7. The operator can view the four ink tanks 10 through the window portion 25, which is an opening. Note that the window portion 25 is not limited to an opening, and may be constituted by a member that is optically transparent.

In the present embodiment, at least a portion of a wall of the ink container 29, of each of the ink tanks 10, that opposes the window portion 25 is optically transparent. The ink inside the ink container 29 can be viewed through the portion, of each of the ink containers 29, that is optically transparent. Accordingly, the operator can recognize the ink amount in the ink container 29 in each of the ink tanks 10 by viewing the four ink tanks 10 through the window portion 25. That is, at least a portion of the part, of the ink tank 10, that opposes the window portion 25 can be utilized as a viewing portion through which the ink amount can be recognized. Therefore, the operator can view the viewing portion of each of the four ink tanks 10 in the housing 7 using the window portion 25. Note that the entirety of the wall of the ink container 29 may be optically transparent. Also, the entirety of the part, of the ink tank 10, that opposes the window portion 25 can be utilized as the viewing portion through which the ink amount can be recognized.

In the printer 1, the scanner unit 5 is overlaid on the printing unit 3. In a state in which the printing unit 3 is used, the scanner unit 5 is located vertically above the printing unit 3. The scanner unit 5 is a flatbed type of scanner unit, and includes a document cover 31 that pivots so as to open and close, and a document mounting surface (not shown) that is exposed when the document cover 31 is opened. The scanner unit 5 includes an imaging element (not shown) such as an image sensor. The scanner unit 5 can read an image that is rendered on a document such as a piece of paper that is placed on the document mounting surface as image data using the imaging element. Accordingly, the scanner unit 5 functions as a reading device of an image or the like.

Figure 2:
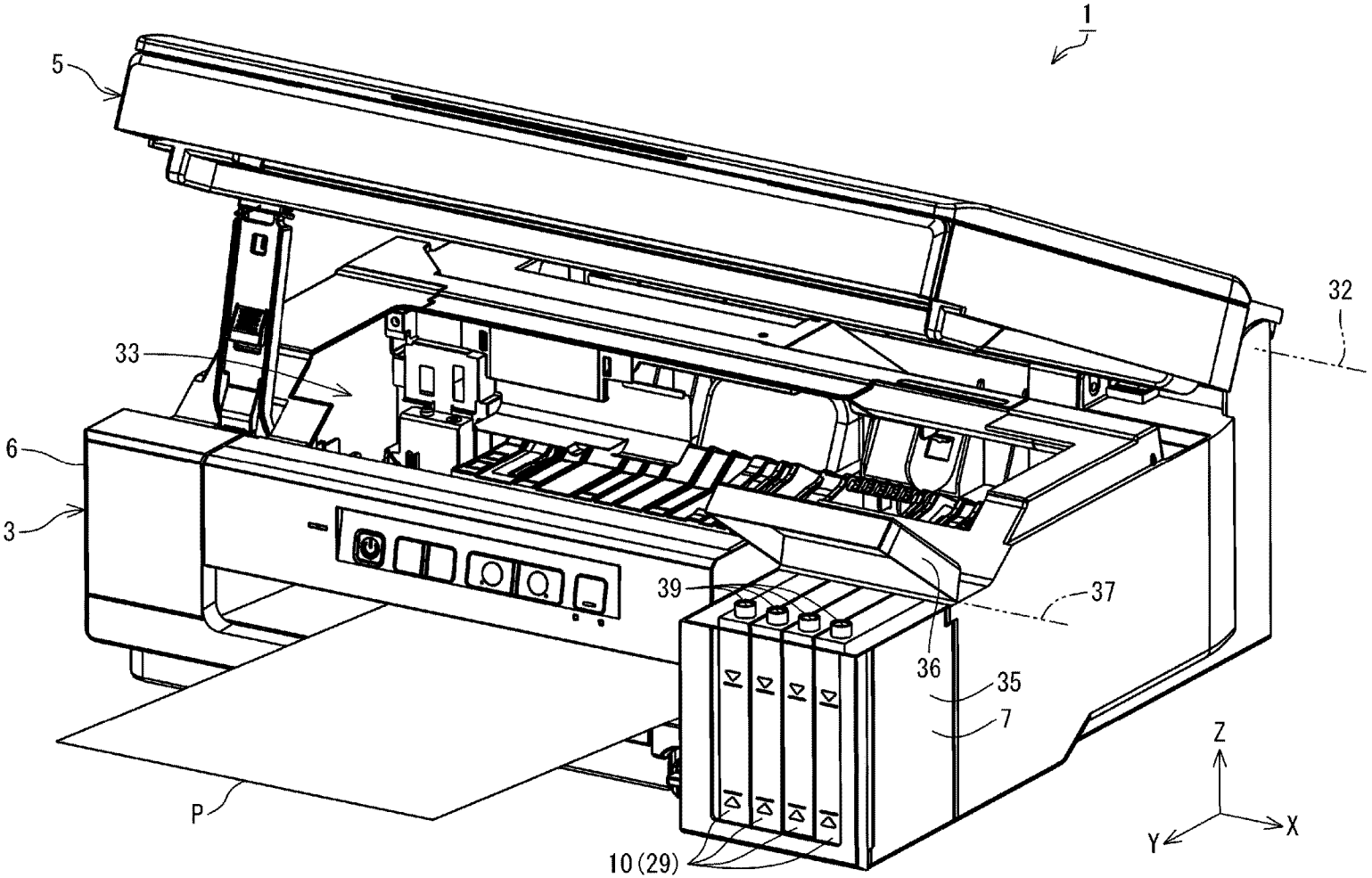
FIG. 2 is a perspective view illustrating the main configuration of the printer in the present embodiment.

The scanner unit 5 is configured to be capable of pivoting relative to the printing unit 3, as shown in FIG. 2. The scanner unit 5 is configured to be capable of pivoting about a pivoting shaft 32 that extends along the X axis. An opening 33 is formed in the housing 6 of the printing unit 3. The scanner unit 5 also functions as a cover that covers the opening 33 of the housing 6 of the printing unit 3. The operator can pivot the scanner unit 5 relative to the printing unit 3 by lifting the scanner unit 5 in the Z axis direction. Accordingly, the scanner unit 5 that functions as a cover for the printing unit 3 can be opened relative to the printing unit 3. When the scanner unit 5 is opened relative to the printing unit 3, the opening 33 of the housing 6 is opened. In FIG. 2, a state in which the scanner unit 5 is opened relative to the printing unit 3, that is, a state in which the opening 33 of the housing 6 is exposed is illustrated.

Note that the state in which the scanner unit 5 is opened relative to the printing unit 3, that is, the state in which the opening 33 of the housing 6 is exposed, is referred to as an open state. Also, the state in which the scanner unit 5 is closed relative to the printing unit 3, that is, the state in which the opening 33 of the housing 6 is covered by the scanner unit 5, is referred to as a closed state. Therefore, in the printer 1, the scanner unit 5 is a cover that can be switched between a closed state in which the opening 33 formed in the housing 6 is covered and an open state in which the opening 33 is exposed. Also, the state of the scanner unit 5, which is an example of a cover, changes from a closed state to an open state as the posture of the scanner unit 5 changes relative to the housing 6 as a result of pivoting. That is, in the printer 1, the state of the scanner unit 5, which is an example of a cover, can be changed from a closed state to an open state as a result of pivoting.

Also, as shown in FIG. 2, the housing 7 includes a body portion 35 and a tank cover 36. The tank cover 36 is configured to be capable of pivoting relative to the body portion 35, and is configured to be capable of opening and closing the body portion 35. The tank cover 36 is configured to be capable of pivoting about a pivoting shaft 37 that extends along the X axis. The ink tanks 10 are housed in the body portion 35. The tank cover 36 functions as a cover that covers the body portion 35. As a result of a force in the Z axis direction acting on the tank cover 36, the tank cover 36 pivots relative to the body portion 35. Accordingly, the tank cover 36 that functions as a cover for the body portion 35 is opened relative to the body portion 35. The state of the tank cover 36 changes from a closed state to an open state as the posture of the tank cover 36 changes relative to the body portion 35 as a result of pivoting. That is, in the printer 1, the state of the tank cover 36 can be changed from a closed state to an open state as a result of pivoting.

Each ink tank 10 includes an ink inlet port 39. In the ink tank 10, ink can be injected into the ink tank 10 from the outside of the ink tank 10 via the ink inlet port 39. When the tank cover 36 is opened relative to the body portion 35, the ink inlet ports 39 of the ink tanks 10 are exposed. Note that, in FIG. 2, the state in which the tank cover 36 is opened relative to the body portion 35, that is, the state in which the ink inlet ports 39 of the ink tanks 10 are exposed is illustrated.

The state in which the tank cover 36 is opened relative to the body portion 35, that is, the state in which the ink inlet ports 39 of the ink tanks 10 are exposed, is referred to as an open state. Also, the state in which the tank cover 36 is closed relative to the body portion 35, that is, the state in which the ink inlet ports 39 of the ink tanks 10 are covered by the tank cover 36 is referred to as a closed state. Therefore, in the printer 1, the tank cover 36 is configured to be capable of being switched between a closed state in which the ink inlet ports 39 of the ink tanks 10 are covered and an open state in which the ink inlet ports 39 are exposed.

A configuration in which each ink inlet port 39 is sealed by a cap member (not shown) can be adopted as the printer 1. In this configuration, when ink is injected into an ink tank 10, the tank cover 36 is brought into an open state, an ink inlet port 39 is opened by removing a cap member from the ink inlet port 39, and thereafter ink is injected. Note that, in the printer 1, the ink inlet port 39 is directed upward relative to the horizontal direction in a use posture.

Figure 3:
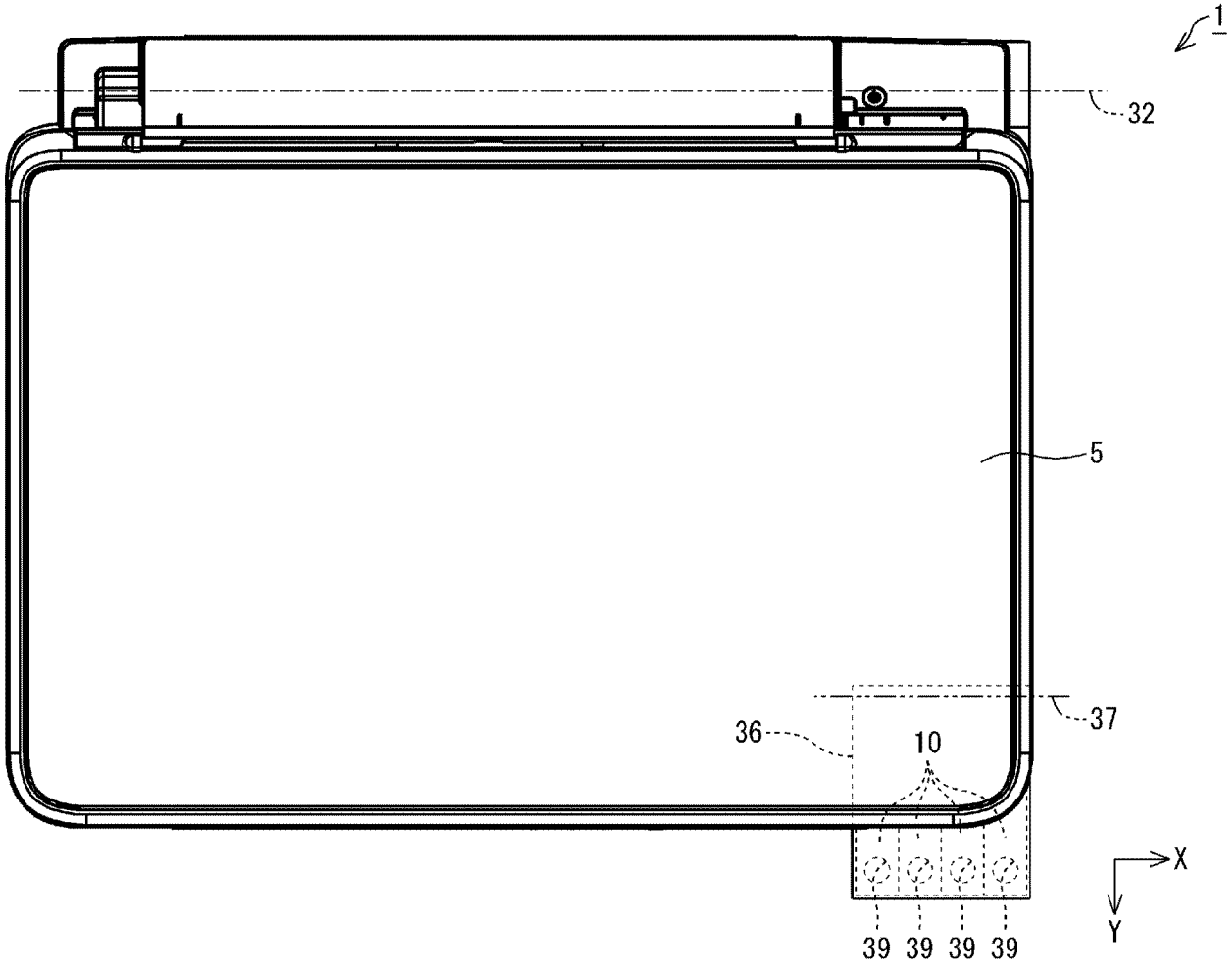
FIG. 3 is a plan view illustrating the main configuration of the printer in the present embodiment.

In the printer 1, when the tank cover 36 and the scanner unit 5 are each in a closed state, the scanner unit 5 is overlapped with a portion of the tank cover 36, as shown in FIG. 1. That is, in a use posture, when the scanner unit 5 in a closed state is viewed in plan view in the −Z axis direction, the scanner unit 5 covers a portion of the tank cover 36, as shown in FIG. 3. Accordingly, when the scanner unit 5 is in a closed state, the tank cover 36 is also in a closed state. When the scanner unit 5 is in an open state, the tank cover 36 can be brought into an open state.

Also, in the printer 1, the ink inlet ports 39 are located outside the region of the scanner unit 5, as shown in FIG. 3. In the printer 1, the ink inlet ports 39 are located on the Y axis direction side relative to the scanner unit 5. Therefore, in the printer 1, when the scanner unit 5 in a closed state is viewed in plan view in the −Z axis direction, the scanner unit 5 is not overlapped with the ink inlet ports 39. Therefore, blockage of the ink inlet port 39 by the scanner unit 5 can be easily avoided. As a result, a printer 1 in which ink can be easily injected into the ink inlet port 39 of an ink tank 10 can be provided.

Figure 4:
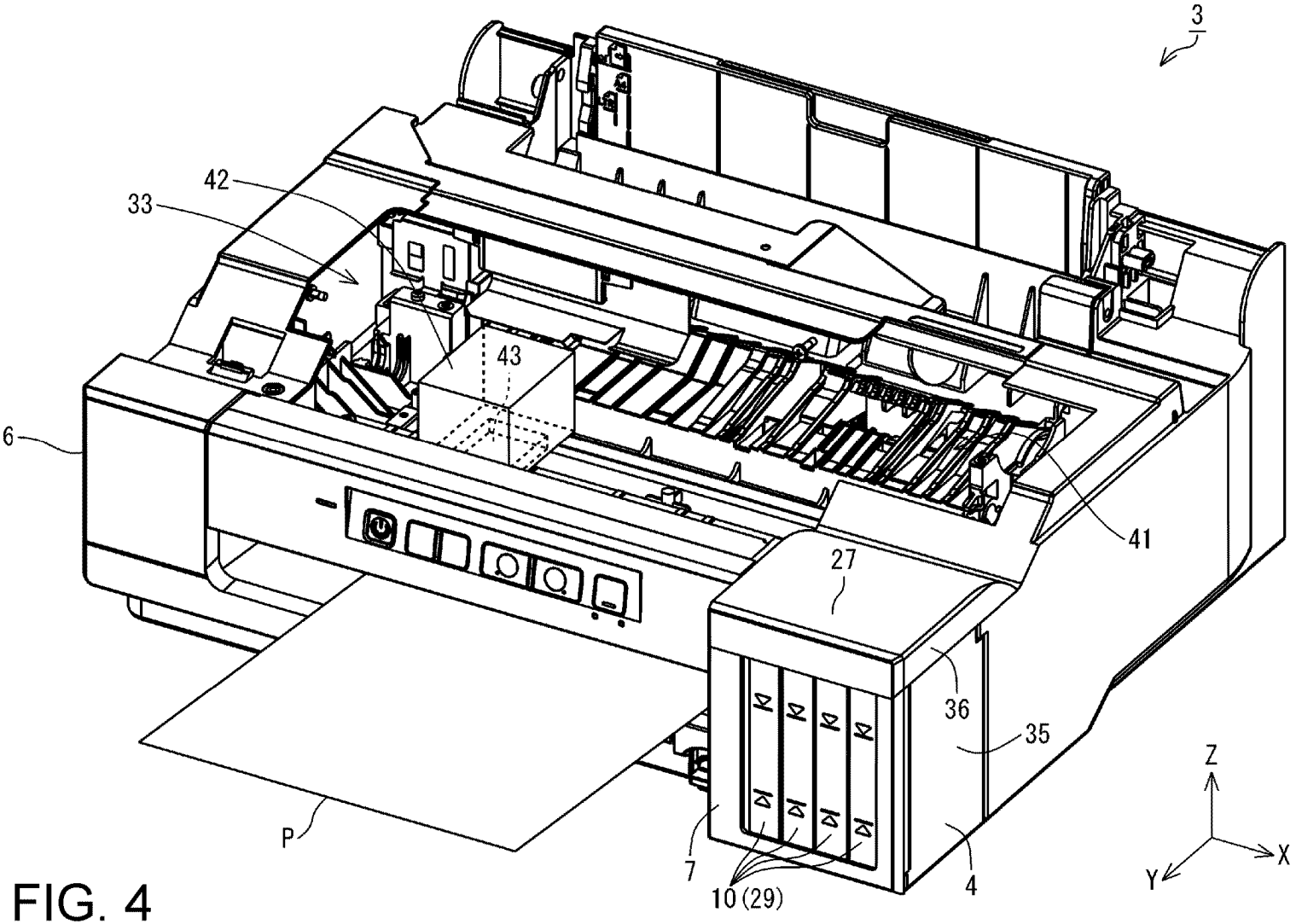
FIG. 4 is a perspective view illustrating a main configuration of a printing unit in the present embodiment.
Figure 5:
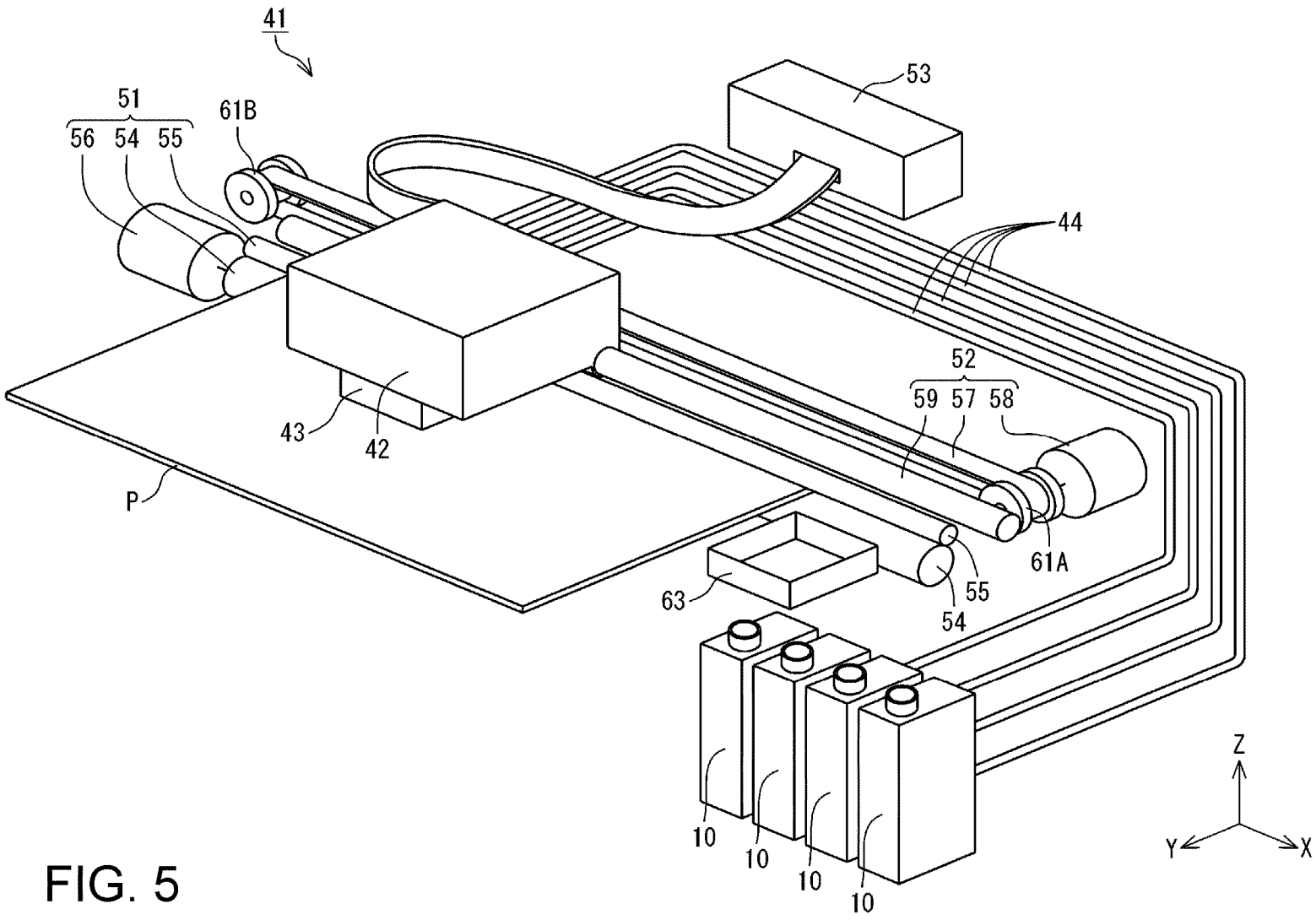
FIG. 5 is a perspective view schematically illustrating a main configuration of a mechanism unit in the present embodiment.

The printing unit 3 includes a mechanism unit 41, as shown in FIG. 4. The mechanism unit 41 includes a carriage 42. A printing head 43 that can eject ink is mounted on the carriage 42. In the printing unit 3, the carriage 42 is housed in the housing 6. That is, the housing 6 houses the printing head 43. The printing head 43 performs printing on a printing medium P that is conveyed in the Y axis direction by a medium conveyance device (described later) using ink. Note that the medium conveyance device intermittently conveys a printing medium P in the Y axis direction. The carriage 42 is configured to be capable of being moved back and forth along the X axis by a moving device (described later). The tank unit 4 supplies ink to the printing head 43 via ink supply tubes 44 (FIG. 5).

Here, a direction parallel with the X axis is not limited to a direction that is perfectly parallel with the X axis, and also includes a direction that is inclined relative to the X axis due to an error, a tolerance, or the like, excluding a direction perpendicular to the X axis. Similarly, a direction parallel with the Y axis is not limited to a direction that is perfectly parallel with the Y axis, and also includes a direction that is inclined relative to the Y axis due to an error, a tolerance, or the like, excluding a direction perpendicular to the Y axis. A direction parallel with the Z axis is not limited to a direction that is perfectly parallel with the Z axis, and also includes a direction that is inclined relative to the Z axis due to an error, a tolerance, or the like, excluding a direction perpendicular to the Z axis. That is to say, a direction parallel to an axis or a plane is not limited to a direction that is perfectly parallel with this axis or plane, and also includes a direction that is inclined relative to this axis or plane due to an error, a tolerance, or the like, excluding a direction perpendicular to this axis or plane.

The tank unit 4 includes the ink tanks 10. In the present embodiment, the tank unit 4 includes a plurality of (four, present embodiment) ink tanks 10. The plurality of ink tanks 10 are located outside the housing 6 of the printing unit 3. The plurality of ink tanks 10 are housed in the housing 7. Accordingly, the ink tanks 10 can be protected by the housing 7. The housing 7 is located outside the housing 6. Note that, in the present embodiment, the tank unit 4 includes the plurality of (four) ink tanks 10. However, the number of ink tanks 10 is not limited to four, and may be three or less, or more than four.

Furthermore, in the present embodiment, the plurality of ink tanks 10 are configured to be separate from each other. However, the configuration of the ink tanks 10, which are one example of a liquid container, is not limited in this way. The liquid container can be configured as a single liquid container in which the plurality of ink tanks 10 are integrated. In this case, one liquid container is provided with a plurality of liquid containers. The plurality of liquid containers are configured to be individually separated from each other and be able to contain different types of liquids. In this case, for example, ink of different colors can be separately contained in the respective liquid containers. The method for integrating the plurality of ink tanks 10 into a single liquid container includes a method in which the plurality of ink tanks 10 are integrally joined or coupled, a method in which the plurality of ink tanks 10 are integrated through an integral molding, and the like.

The mechanism unit 41 includes a medium conveyance device 51 and a moving device 52, as shown in FIG. 5. The medium conveyance device 51 intermittently conveys a printing medium P in the Y axis direction. The moving device 52 moves the carriage 42 back and forth along the X axis. The driving of the constituent elements described above are controlled by the control unit 53.

The medium conveyance device 51 includes a drive roller 54, a driven roller 55, and a conveyance motor 56. The drive roller 54 and the driven roller 55 are configured to be in contact with each other at outer circumferential surfaces thereof and be rotatable. The conveyance motor 56 produces power for rotationally driving the drive roller 54. The power from the conveyance motor 56 is transmitted to the drive roller 54 via a transmission mechanism. A printing medium P sandwiched between the drive roller 54 and the driven roller 55 is intermittently conveyed in the Y axis direction.

The moving device 52 includes a timing belt 57, a carriage motor 58, and a guide shaft 59. The timing belt 57 is stretched in a taut state between a pair of pulleys 61A and 61B. The pair of pulleys 61A and 61B are arranged along the X axis. Accordingly, the timing belt 57 is stretched in a taut state along the X axis. The carriage motor 58 generates power to rotationally driving the pulley 61A. The guide shaft 59 extends along the X axis. The guide shaft 59 is supported at both ends by an unshown housing, and guides the carriage 42 along the X axis.

The carriage 42 is fixed to a portion of the timing belt 57. Power is transmitted to the carriage 42 from the carriage motor 58 via the pulley 61A and the timing belt 57. The carriage 42 is configured to be able to move back and forth along the X axis by the transmitted power.

Also, the mechanism unit 41 includes a cap 63 that can cover the printing head 43, as shown in FIG. 5. The cap 63 is arranged at a position so as to overlap a locus that is depicted by the printing head 43 when the carriage 42 is moved along the X axis, when the printing unit 3 is viewed in plan view in the −Z axis direction. Therefore, when the carriage 42 is moved along the X axis, there is a position at which the printing head 43 is overlapped with the cap 63. In the present embodiment, the printing head 43 can be covered by the cap 63 by moving the cap 63 upward in the Z axis direction at the position at which the printing head 43 and the cap 63 overlap each other when the printing unit 3 is viewed in plan view in the −Z axis direction.

As a result of covering the printing head 43 with the cap 63, the evaporation of liquid components in the ink from a nozzle opening (not shown) of the printing head 43 can be suppressed. Accordingly, because the solidification of ink inside the nozzle opening can be easily avoided, degradation in print quality due to the printing head 43 can be suppressed.

Figure 6:
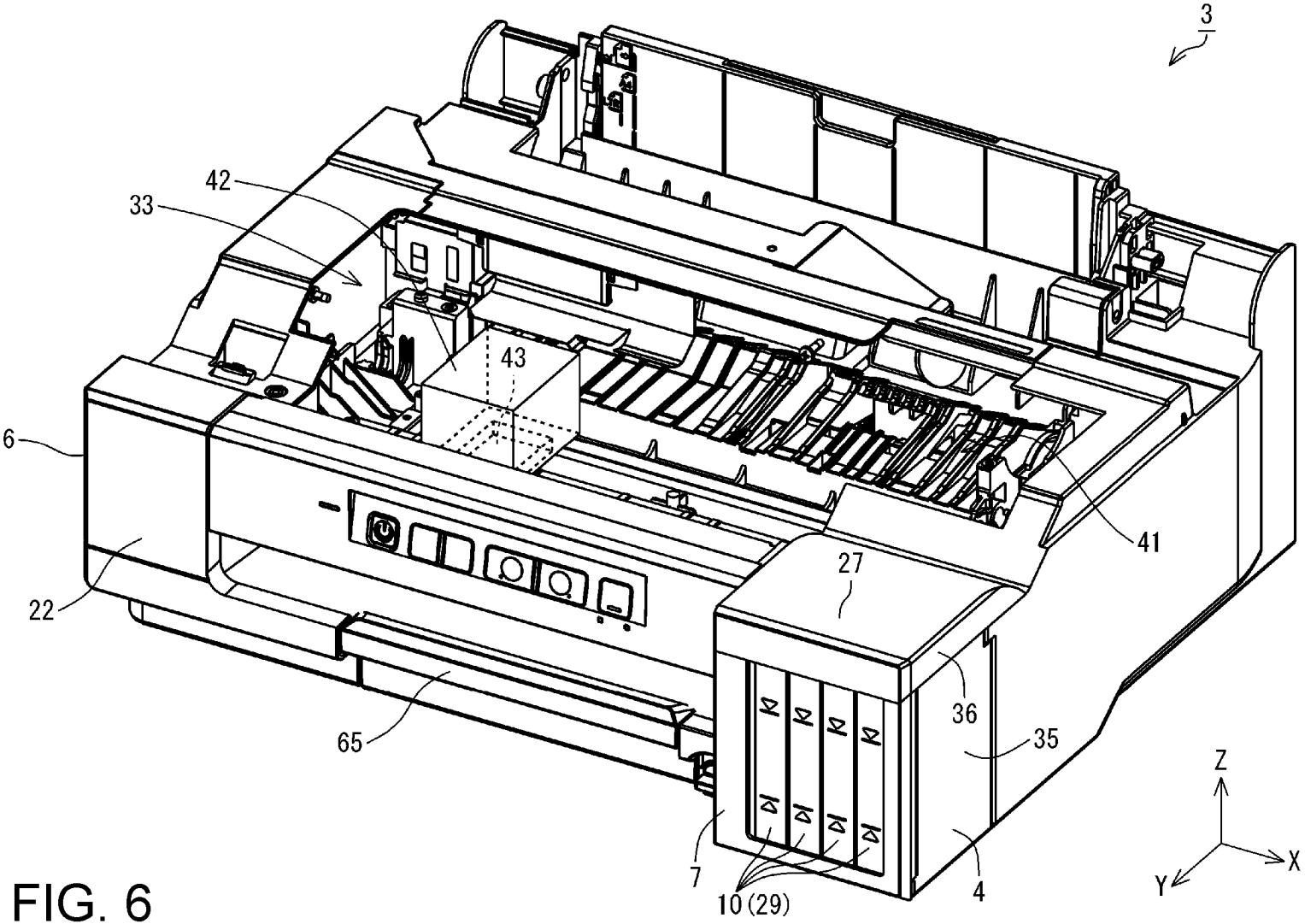
FIG. 6 is a perspective view illustrating the main configuration of the printing unit in the present embodiment.

Here, the printing unit 3 is provided with a medium supply tray 65, as shown in FIG. 6. The medium supply tray 65 is configured to be able to be attached to and detached from the printing unit 3. The medium supply tray 65 is provided in the front face 22 of the printing unit 3. The medium supply tray 65 is configured to be able to house a plurality of printing mediums P. A printing medium P can be supplied from the medium supply tray 65 in the printing unit 3.

Figure 7:
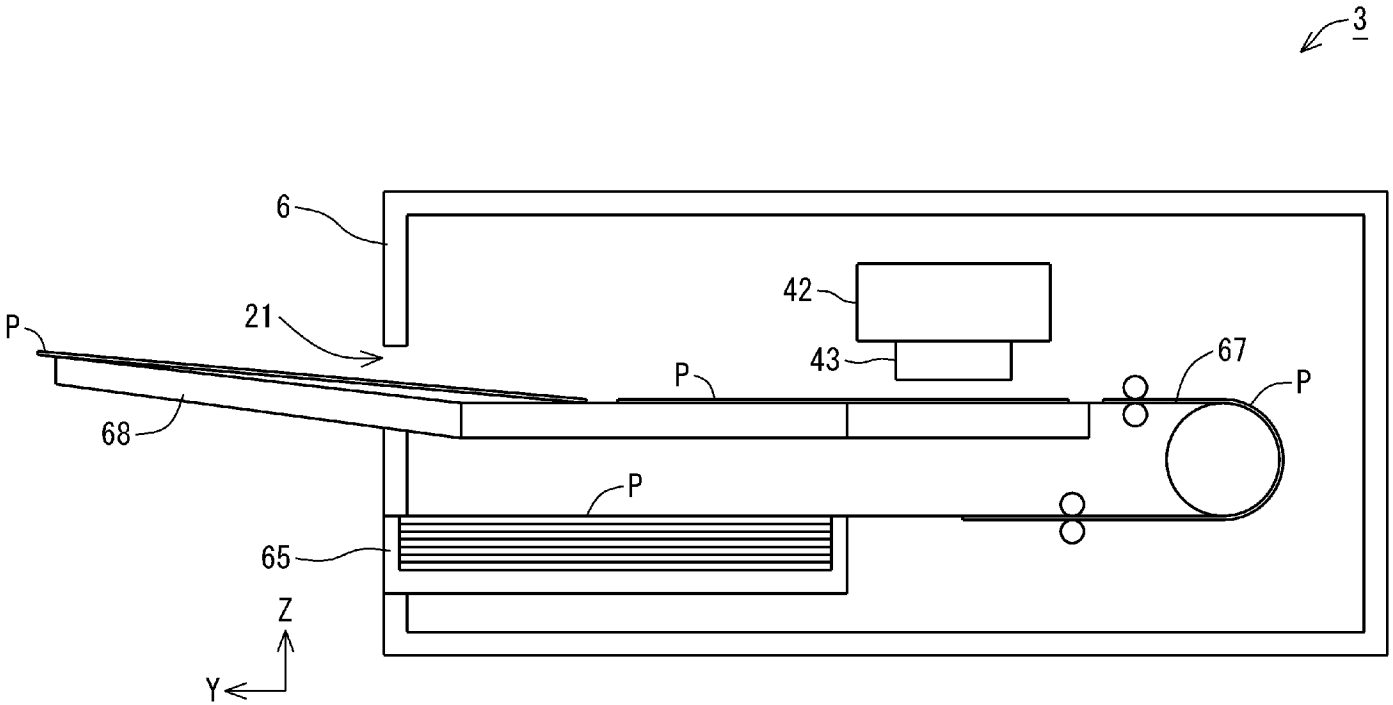
FIG. 7 is a cross-sectional view schematically illustrating the printing unit in the present embodiment.

The printing medium P that has been supplied to the printing unit 3 from the medium supply tray 65 is conveyed along a conveyance path 67 that is set in the printing unit 3, as shown in FIG. 7, which is a cross-sectional view schematically showing the printing unit 3. Printing by the printing head 43 is performed on the printing medium P when the printing medium P passes under the printing head 43 in the conveyance path 67. The printing medium P that has passed under the printing head 43 is discharged from the discharge port 21 to the outside of the printing unit 3. Here, the printing medium P discharged from the discharge port 21 is placed in a stacker 68 that is provided in the printing unit 3 so as to be able to move in and out of the printing unit 3. The stacker 68 is configured to be able to move in and out of the printing unit 3 in a direction along the Y axis.

Figure 8:
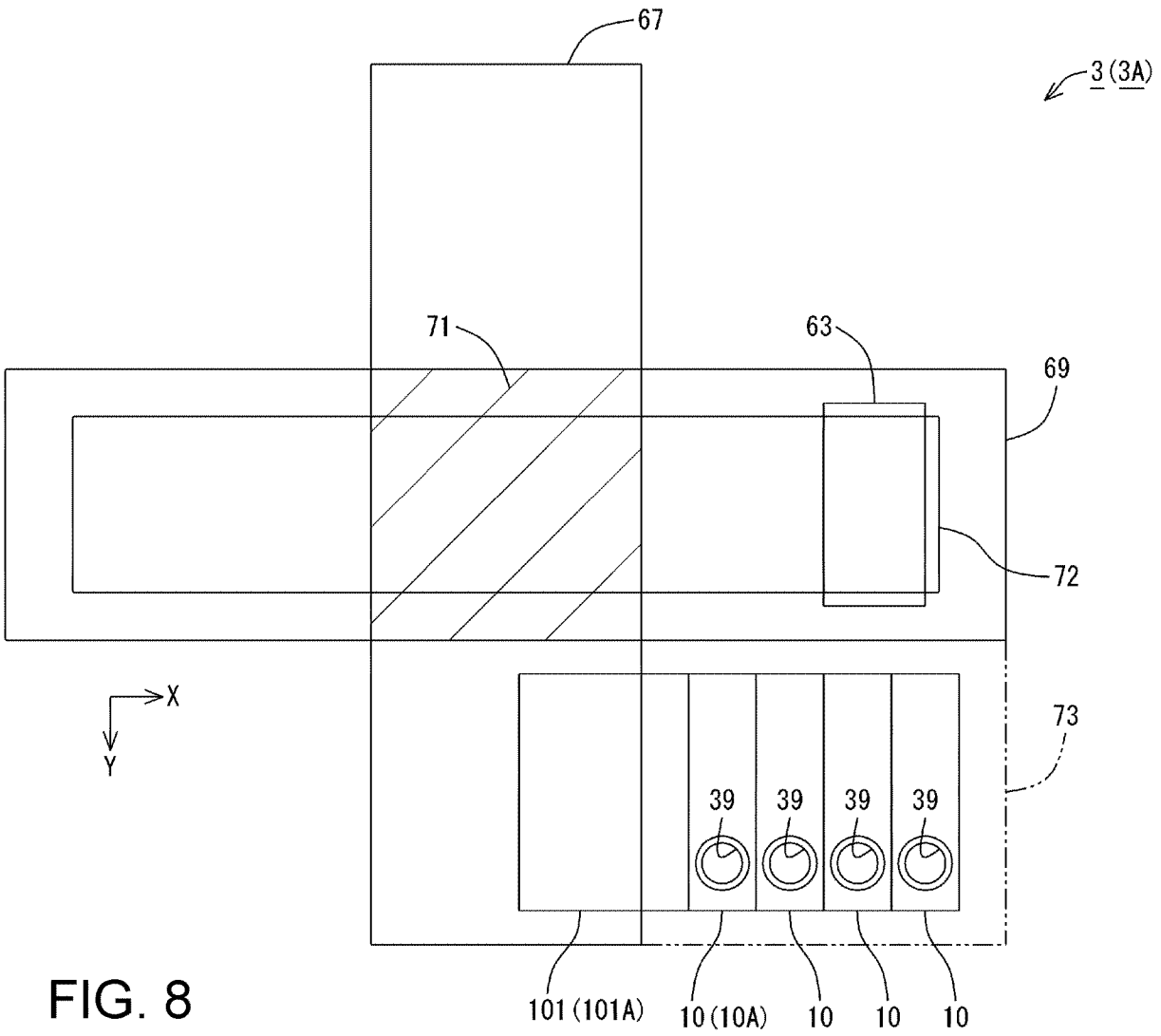
FIG. 8 is a plan view schematically illustrating the printing unit in the present embodiment.

Note that the conveyance path 67 includes, when the printing unit 3 is viewed in plan view in the −Z axis direction, a region that overlaps the printing mediums P housed in the medium supply tray 65, and a region that is overlapped with the printing medium P placed in the stacker 68. The state in which the printing unit 3 is viewed in plan view in the −Z axis direction corresponds to a state in which the printing unit 3 is viewed in a direction along which ink is ejected from the printing head 43. When the printing unit 3 is viewed in plan view in the −Z axis direction, the conveyance path 67 extends along the Y axis, as shown in FIG. 8.

The range in which the carriage 42 can move is referred to as a movable region 69 of the carriage 42. When the carriage 42 is moved through the entire region of the movable region 69 in a state in which the printing unit 3 is viewed in plan view in the −Z axis direction, the movable region 69 is a region of the locus depicted by the carriage 42. The movable region 69 extends along the X axis. When the printing unit 3 is viewed in plan view in the −Z axis direction, the conveyance path 67 and the movable region 69 intersect each other. The region in which the conveyance path 67 and the movable region 69 overlap is referred to as an intersection region 71.

Note that, in the present embodiment, the cap 63 described above is arranged on the X axis direction side relative to the conveyance path 67, when the printing unit 3 is viewed in plan view in the −Z axis direction. When the carriage 42 is moved through the entire region of the movable region 69, a region 72 of the locus depicted by the printing head 43 is located inside the movable region 69. Therefore, the cap 63 is located inside the movable region 69. Accordingly, the cap 63 is arranged on the X axis direction side relative to the intersection region 71. That is, the direction from the intersection region 71 toward the cap 63 corresponds to the +X axis direction. Also, the direction from the intersection region 71 toward the discharge port 21 (FIG. 1) corresponds to the +Y axis direction.

In the present embodiment, when the printing unit 3 is viewed in plan view in the −Z axis direction, the ink tanks 10 are arranged outside the movable region 69. Therefore, the ink tanks 10 are not overlapped with the movable region 69. In the present embodiment, the ink tanks 10 are arranged on the Y axis direction side relative to the movable region 69. Furthermore, the ink tanks 10 are located on the −X axis direction side relative to the end portion of the movable region 69 on the X axis direction side. That is, the ink tanks 10 do not protrude in the X axis direction from the end portion of the movable region 69 on the X axis direction side.

Figure 9:
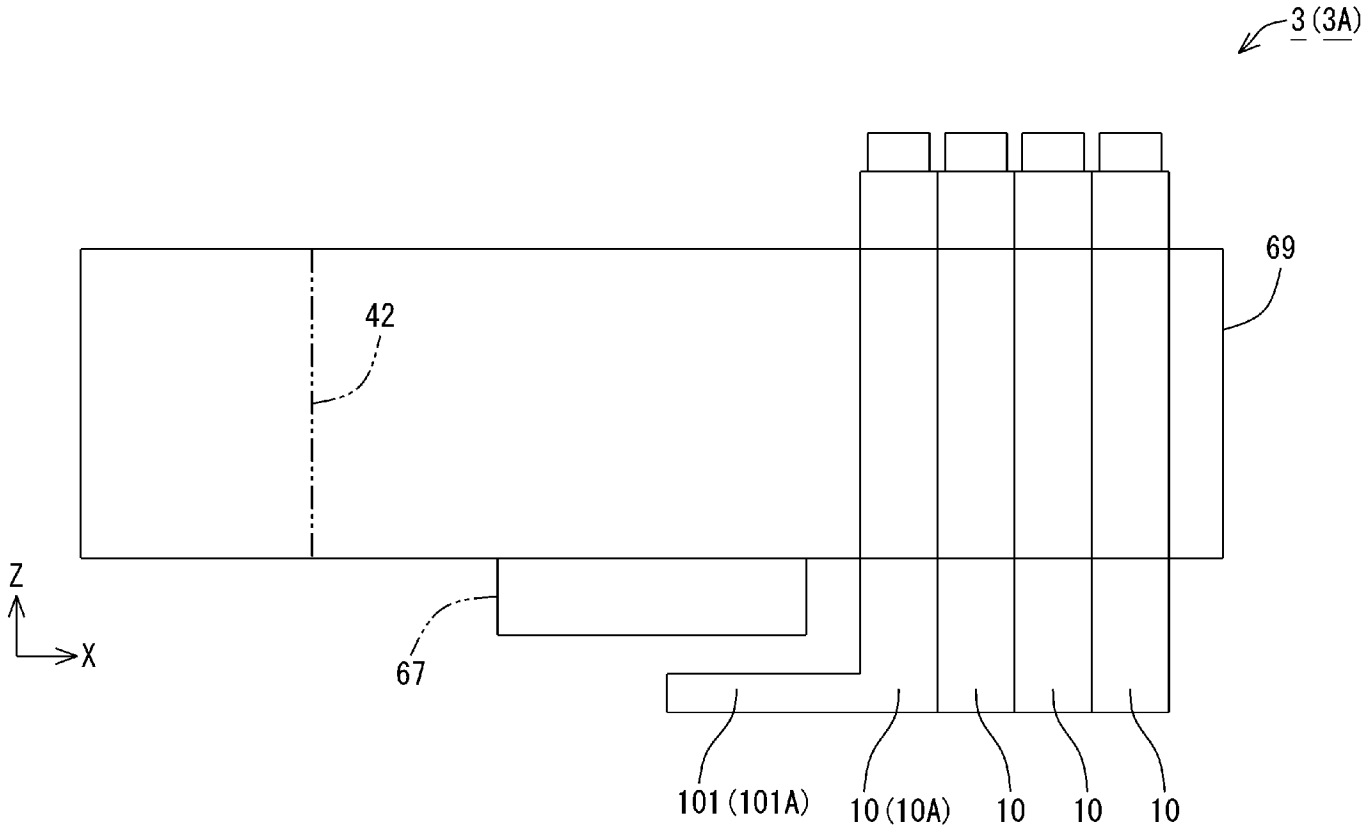
FIG. 9 is a front view schematically illustrating the printing unit in the present embodiment.

Also, in the present embodiment, when the printing unit 3 is viewed in plan view in the −Z axis direction, the ink tanks 10 are arranged so as to extend across a region on the X axis direction side relative to the conveyance path 67 and a region that is overlapped with the conveyance path 67. That is, the ink tanks 10 are arranged so as to extend across a region 73 outside the conveyance path 67 on the X axis direction side, and the region that is overlapped with the conveyance path 67. Furthermore, when the printing unit 3 is viewed in a direction along the Y axis, the ink tanks 10 are overlapped with the movable region 69 of the carriage 42, as shown in FIG. 9. The direction along the Y axis corresponds to a direction orthogonal to the −Z axis direction, which is the direction in which ink is ejected from the printing head 43, and the X axis. That is, when the printing unit 3 is viewed in a direction orthogonal to the direction in which ink is ejected from the printing head 43 and the X axis, the ink tanks 10 are overlapped with the movable region 69 of the carriage 42. Note that, in FIG. 9, a state is shown in which the printing unit 3 is viewed in the −Y axis direction, which is an example of the direction along the Y axis.

In the present embodiment, when the printing unit 3 is viewed in plan view in the −Z axis direction, the ink inlet ports 39 of the ink tanks 10 are located in the region 73 outside the conveyance path 67 on the X axis direction side, as shown in FIG. 8. Accordingly, in the present embodiment, it can also be described that, when the printing unit 3 is viewed in plan view in the −Z axis direction, a portion of the ink tanks 10 that are arranged in a region outside the conveyance path 67 on the X axis direction is overlapped with the conveyance path 67 as well.

Various examples of the printing unit 3 will be described. When the printing unit 3, the ink tank 10, and members that constitute the printing unit 3 (hereinafter, referred to as constituent members) are identified in the respective examples below, different letters, signs, and the like are appended to reference signs for the printing unit 3, the ink tank 10, and the constituent members in each example.

Example 1

In a printing unit 3A in Example 1, one ink tank 10A out of the plurality of ink tanks 10 is arranged so as to extend across the region 73 outside the conveyance path 67 on the X axis direction side and a region that is overlapped with the conveyance path 67, as shown in FIG. 8. In the printing unit 3A in Example 1, a portion of the ink tank 10A is located below the conveyance path 67, as shown in FIG. 9.

Figure 10:
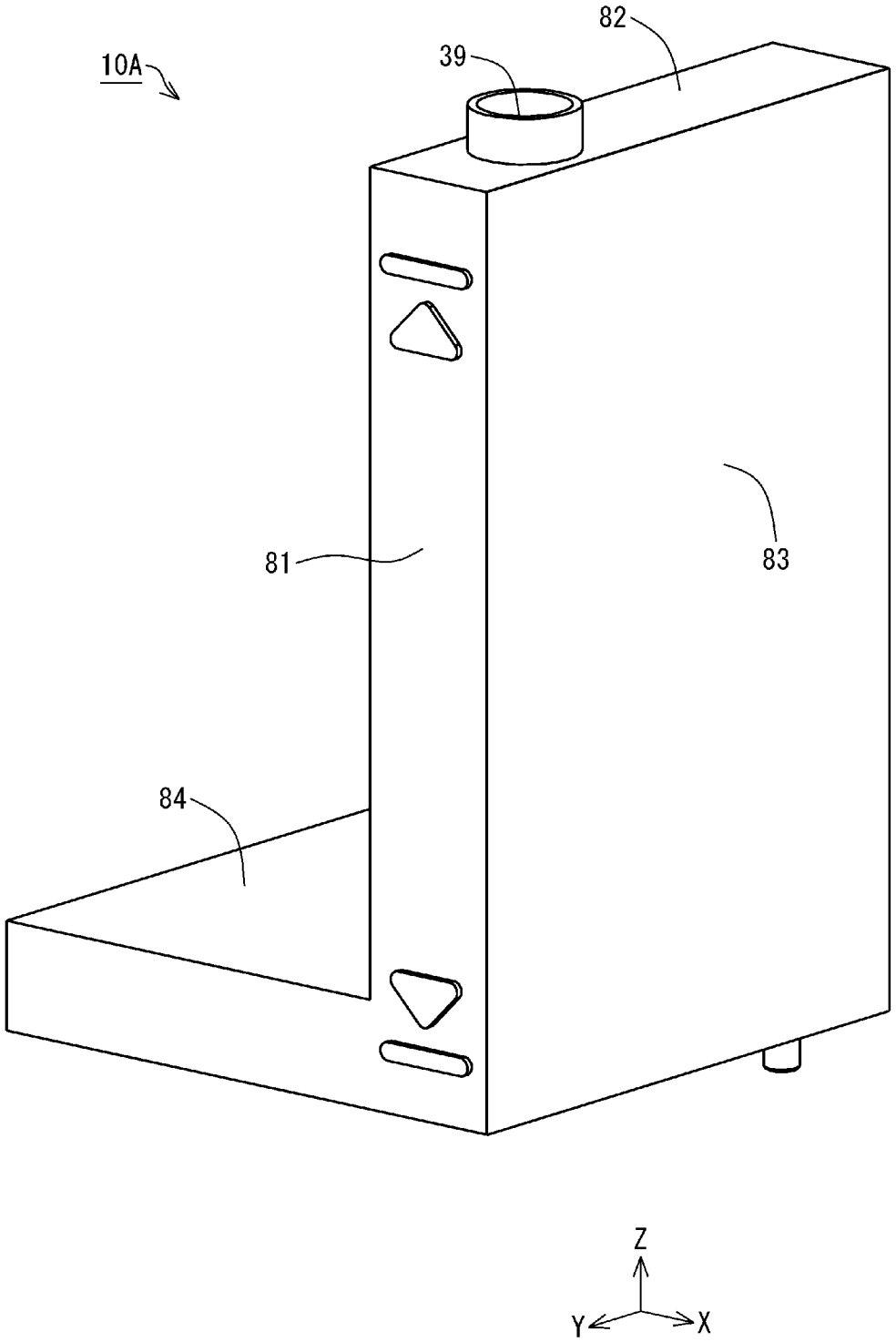
FIG. 10 is a perspective view illustrating a main configuration of an ink tank in Example 1.
Figure 11:
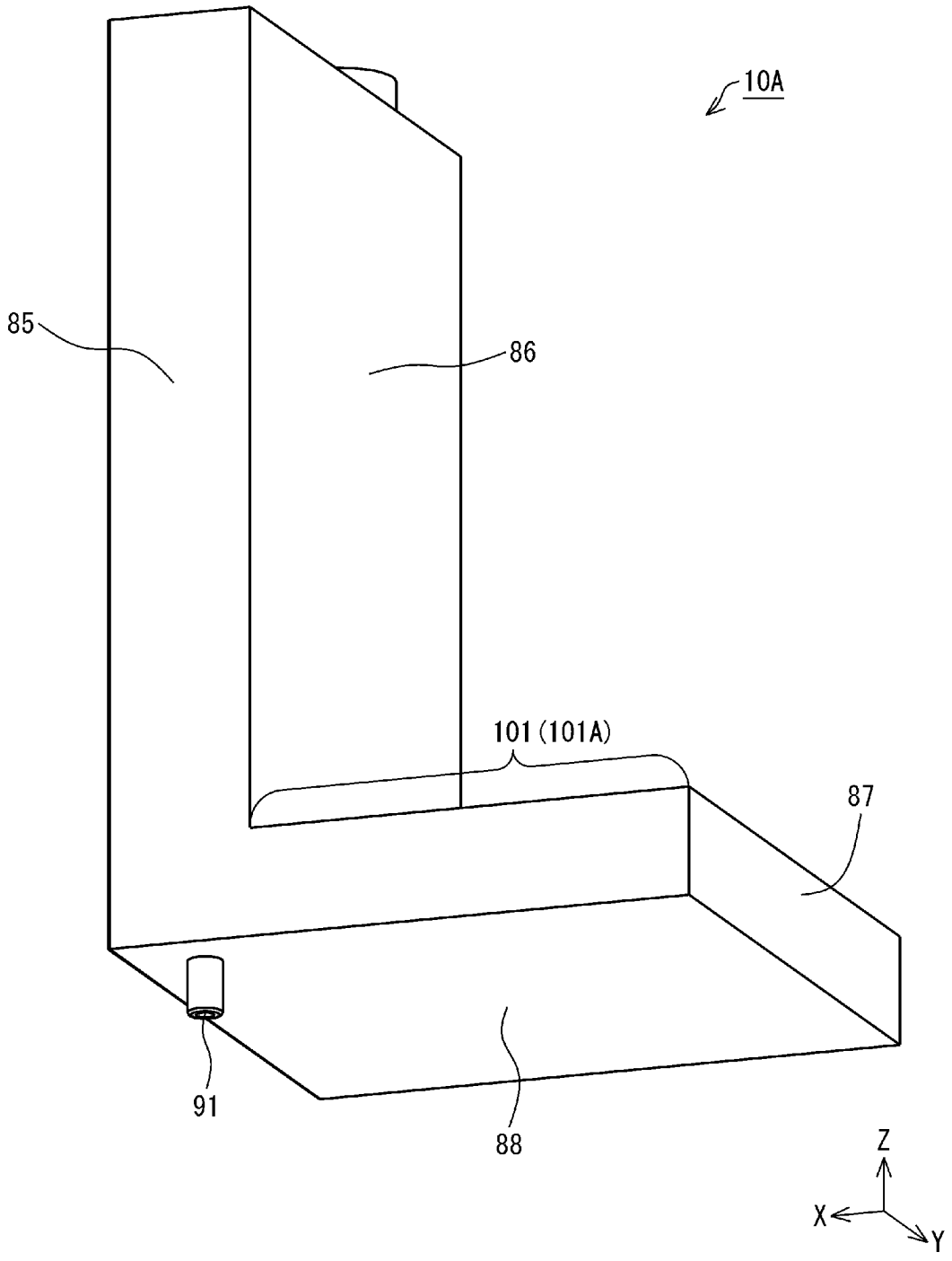
FIG. 11 is a perspective view illustrating the main configuration of the ink tank in Example 1.

The ink tank 10A in Example 1 includes a first wall 81, a second wall 82, a third wall 83, and a fourth wall 84, as shown in FIG. 10. The first wall 81 is a wall that faces the Y axis direction. The third wall 83 is a wall that faces the X axis direction. The second wall 82 and the fourth wall 84 are walls that face the Z axis direction. The ink inlet port 39 is formed in the second wall 82. Also, the ink tank 10A includes a fifth wall 85, a sixth wall 86, a seventh wall 87, and an eighth wall 88, as shown in FIG. 11. The fifth wall 85 is a wall that faces the −Y axis direction. The sixth wall 86 and the seventh wall 87 are walls that face the −X axis direction. The eighth wall 88 is a wall that faces the −Z axis direction.

As shown in FIG. 10, the first wall 81 extends along an XZ plane. The second wall 82 is located on the Z axis direction side of the first wall 81. The second wall 82 extends along an XY plane. The second wall 82 intersects the first wall 81 at an end portion thereof on the Y axis direction side. The third wall 83 is located on the X axis direction side of the first wall 81 and the second wall 82. The third wall 83 extends along a YZ plane. The third wall 83 intersects the first wall 81 and the second wall 82. The fourth wall 84 is located on the −Z axis direction side relative to the second wall 82. Furthermore, the fourth wall 84 is located on the −X axis direction side relative to the third wall 83. The fourth wall 84 extends along the XY plane. The fourth wall 84 intersects the first wall 81 at an end portion thereof in the Y axis direction.

As shown in FIG. 11, the fifth wall 85 extends along the XZ plane. The fifth wall 85 is located on a side opposite to the first wall 81 (FIG. 10). Therefore, the first wall 81 and the fifth wall 85 are faces that are opposite to each other. The fifth wall 85 intersects the third wall 83 (FIG. 10), the second wall 82, and the fourth wall 84 on a side opposite to the first wall 81 (FIG. 10). The fourth wall 84 (FIG. 10) described above intersects the sixth wall 86 (FIG. 11) at an end portion thereof in the X axis direction. Also, the fourth wall 84 (FIG. 10) intersects the fifth wall 85 (FIG. 11) at an end portion thereof in the −Y axis direction.

As shown in FIG. 11, the sixth wall 86 extends along the YZ plane. The sixth wall 86 is located on a side opposite to the third wall 83 (FIG. 10). The sixth wall 86 intersects the first wall 81, the second wall 82, the fourth wall 84, and the fifth wall 85 (FIG. 11) on a side opposite to the third wall 83 (FIG. 10). As shown in FIG. 11, the seventh wall 87 extends along the YZ plane. The seventh wall 87 is located on the −X axis direction side relative to the sixth wall 86. The seventh wall 87 intersects the first wall 81 (FIG. 10), the fourth wall 84, and the fifth wall 85 (FIG. 11). Also, the seventh wall 87 intersects the eighth wall 88 as well, as shown in FIG. 11.

The eighth wall 88 extends along the XY plane, as shown in FIG. 11. The eighth wall 88 is located on the −Z axis direction side of the fifth wall 85, the seventh wall 87, the first wall 81 (FIG. 10), and the third wall 83. The eighth wall 88 intersects the fifth wall 85, the seventh wall 87, the first wall 81 (FIG. 10), and the third wall 83 at respective end portions of the fifth wall 85, the seventh wall 87, the first wall 81 (FIG. 10), and the third wall 83 on the −Z axis direction side thereof. Note that, in the first wall 81, the second wall 82, the third wall 83, the fourth wall 84, the fifth wall 85, the sixth wall 86, the seventh wall 87, and the eighth wall 88, another flat face, curved face, or the like may be interposed between two walls that intersect to each other.

Also, the term "wall extending along the XZ plane" is not limited to a wall that extends completely parallel to the XZ plane, and also encompasses walls that are inclined relative to the XZ plane by a margin of error, a tolerance, or the like, while excluding a wall that is orthogonal to the XZ plane. Similarly, the term "wall extending along the YZ plane" is not limited to a wall that extends completely parallel to the YZ plane, and also encompasses walls that are inclined relative to the YZ plane by a margin of error, a tolerance, or the like, while excluding a wall that is orthogonal to the YZ plane. The term "wall extending along the XY plane" is not limited to a wall that extends completely parallel to the XY plane, and also encompasses walls that are inclined relative to the XY plane by a margin of error, a tolerance, or the like, while excluding a wall that is orthogonal to the XY plane. Also, the first wall 81, the second wall 82, the third wall 83, the fourth wall 84, the fifth wall 85, the sixth wall 86, the seventh wall 87, and the eighth wall 88 are not limited to being flat walls, and may be uneven, or include a step, or the like.

Also, the term "two walls intersect" refers to a positional relationship in which two walls are not parallel to each other. Besides the case where the two walls are directly in contact with each other, even in a positional relationship where two walls are separated from each other rather than being in direct contact, it can be said that the two walls intersect if an extension of the plane of one wall intersects an extension of the plane of the other wall. The angle formed by the two intersecting walls may be a right angle, an obtuse angle, or an acute angle.

Also, as shown in FIG. 11, a liquid supply portion 91 is provided in the eighth wall 88 of the ink tank 10A. The liquid supply portion 91 protrudes from the eighth wall 88 in the −Z axis direction. The liquid supply portion 91 is in communication with the inside of the ink tank 10A. The ink contained in the ink tank 10A is supplied to the ink supply tube 44 (FIG. 5) via the liquid supply portion 91.

Figure 12:
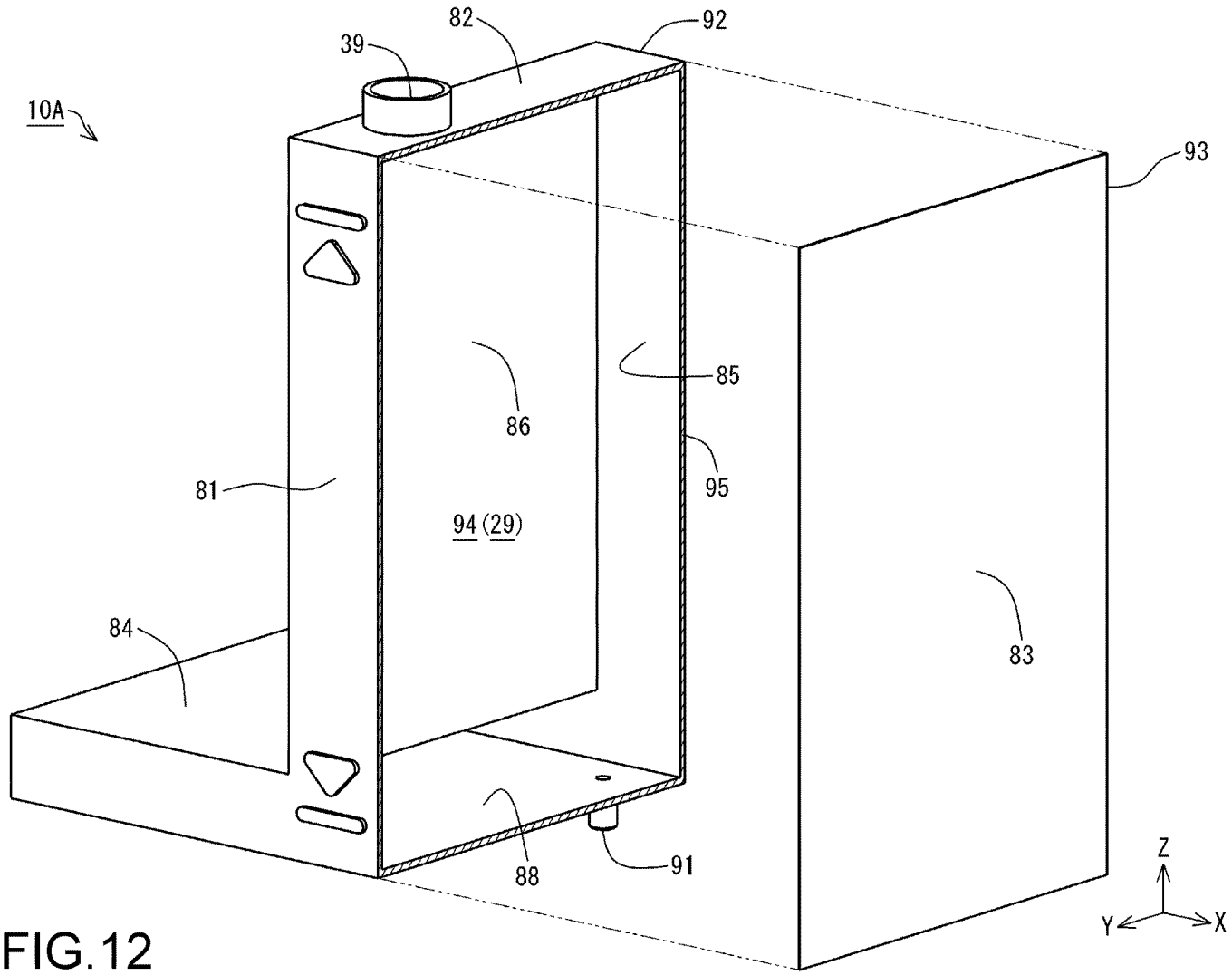
FIG. 12 is an exploded perspective view illustrating the main configuration of the ink tank in Example 1.

The ink tank 10A includes a case 92, which is an example of a tank body, and a sheet member 93, as shown in FIG. 12. The case 92 is made of a synthetic resin such as nylon or polypropylene, for example. Also, the sheet member 93 is formed in the form of a film using a synthetic resin (nylon, polypropylene, or the like, for example), and is bendable. In the present embodiment, the surface of the sheet member 93 that faces the X axis direction corresponds to the third wall 83 of the ink tank 10A. The sheet member 93 is located on the X axis direction side of the case 92, in the ink tank 10A.

A recessed portion 94 is formed in the case 92. The recessed portion 94 is formed in a direction so as to recede in the −X axis direction. Also, the recessed portion 94 is open in the X axis direction. Also, the case 92 is provided with a joint portion 95. The joint portion 95 is hatched in FIG. 12 in order to facilitate understanding of the configuration. The sheet member 93 is joined to the joint portion 95. In the present embodiment, the case 92 and the sheet member 93 are joined through adhesion. When the sheet member 93 is joined to the case 92, the recessed portion 94 is blocked by the sheet member 93. The space surrounded by the recessed portion 94 and the sheet member 93 constitutes the ink container 29.

As shown in FIG. 11, in the ink tank 10A having the configuration described above, a portion of the ink container 29 protrudes in the −X axis direction from the sixth wall 86. In the following, the portion of the ink tank 10A that protrudes in the −X axis direction from the sixth wall 86 is referred to as a protruding container 101. Also, in Example 1, the portion of the ink tank 10A that protrudes in the −X axis direction from the sixth wall 86 is denoted as a protruding container 101A. In the present example, the protruding container 101A of the ink tank 10A is located on the −Z axis direction side relative to the conveyance path 67, as shown in FIG. 9. That is, in a use posture, when the printing unit 3A is viewed in plan view in the −Z axis direction, at least a portion of the ink tank 10A excluding the ink inlet port 39 is overlapped with the region of the conveyance path 67.

In the present example, the protruding container 101A is overlapped with the region of the conveyance path 67. Note that a configuration in which the entirety of the protruding container 101A is overlapped with the region of the conveyance path 67 and a configuration in which a portion of the protruding container 101A is overlapped with the region of the conveyance path 67 can be adopted. That is, a configuration can be adopted in which, when the printing unit 3A is viewed in plan view in the −Z axis direction, at least a portion of the protruding container 101A is overlapped with the region of the conveyance path 67.

According to the configuration described above, in the printing unit 3A, the ink tank 10A is located in a region outside the movable region 69 of the carriage 42 along the Y axis when viewed in a direction in which ink is ejected from the printing head 43, as shown in FIG. 8. Accordingly, it is possible to avoid the case in which the ink tank 10 protrudes from the movable region 69 of the carriage 42 along the X axis. Also, the ink tank 10A is arranged so as to extend across the region 73 outside the conveyance path 67 along the X axis and the region that is overlapped with the conveyance path 67 when viewed in the −Z axis direction. Accordingly, the ink tank 10A can be extended toward the region that is overlapped with the conveyance path 67. Therefore, according to the printing unit 3A, a decrease in the capacity of the ink tank 10A can be easily avoided while downsizing the printer 1.

Example 2

Figure 13:
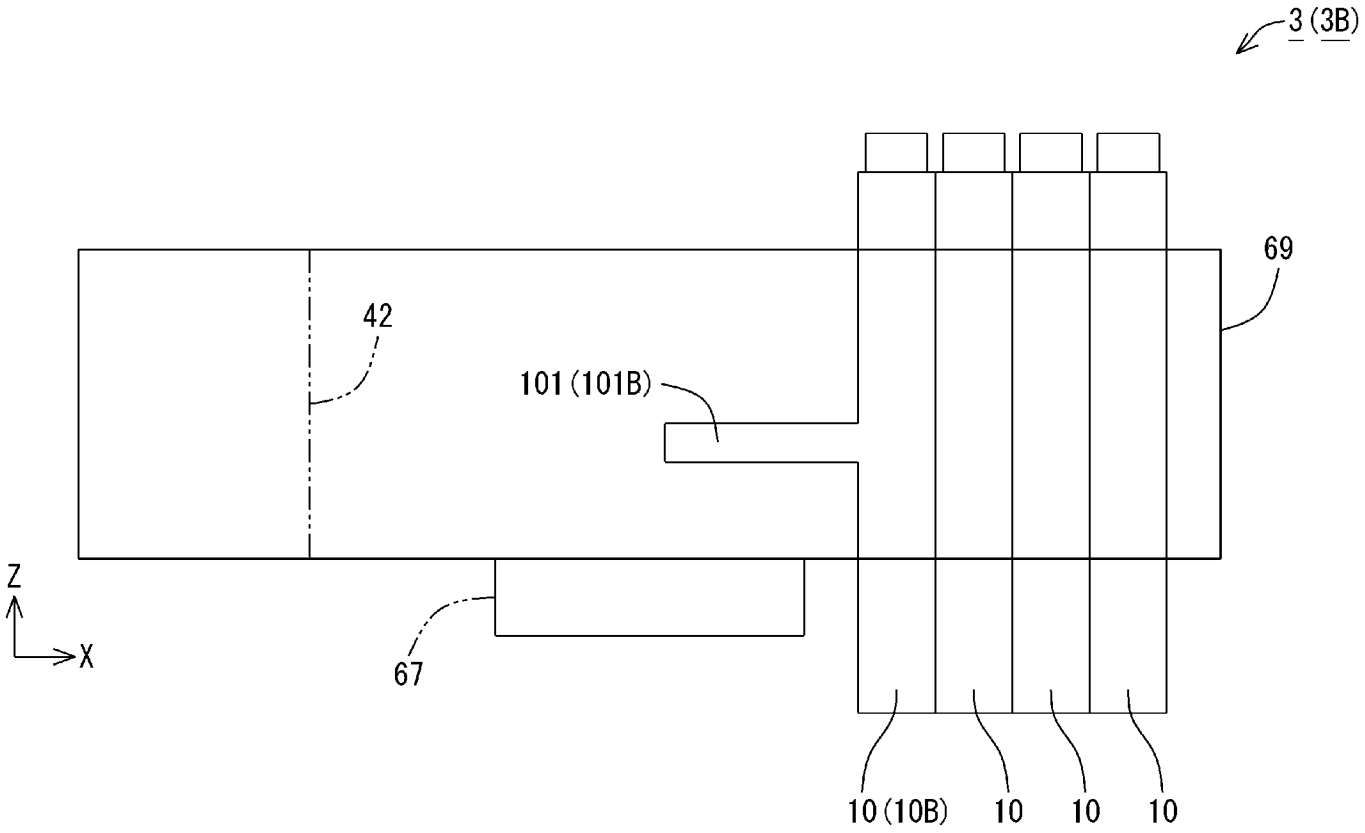
FIG. 13 is a front view schematically illustrating a printing unit in Example 2.

In a printing unit 3B in Example 2, at least a portion of a protruding container 101B of an ink tank 10B is located above the conveyance path 67, as described in FIG. 13. Excluding the above point, the printing unit 3B of Example 2 has the same configuration as the printing unit 3A. In the following, constituent parts that are the same as those in Example 1 and constituent parts that have functions similar to those in Example 1 will be denoted by the same reference signs as in Example 1, and will not be described in detail. Example 2 can also achieve the effects similar to those of Example 1. Note that, in Example 1, since the protruding container 101 is located below the conveyance path 67, compared with Example 2, the dripping of ink onto a printing medium P can be avoided when ink drips along an outer wall of the protruding container 101, for example.

Example 3

Figure 14:
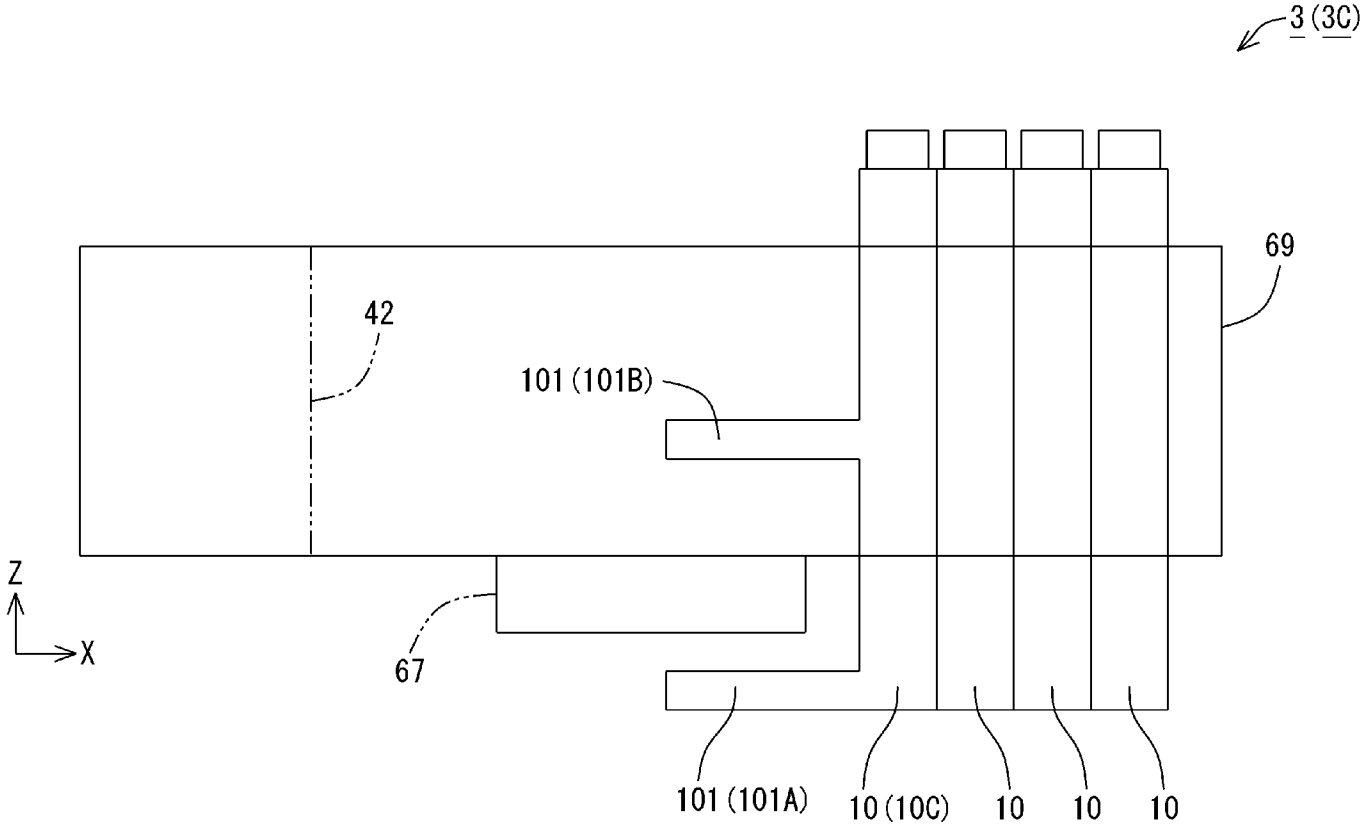
FIG. 14 is a front view schematically illustrating a printing unit in Example 3.

In a printing unit 3C in Example 3, an ink tank 10C includes the protruding container 101A and the protruding container 101B, as shown in FIG. 14. In Example 3, at least a portion of the protruding container 101A is located under the conveyance path 67, and at least a portion of the protruding container 101B is located above the conveyance path 67. Excluding the above point, the printing unit 3C of Example 3 has a similar configuration as the printing unit 3A and the printing unit 3B. In the following, constituent parts that are the same as those in Examples 1 and 2 and constituent parts that have functions similar to those in Examples 1 and 2 will be denoted by the same reference signs as in Examples 1 and 2, and will not be described in detail. Example 3 can also achieve the effects similar to those of Examples 1 and 2. Furthermore, in Example 3, the capacity of the ink tank 10C can be easily increased compared with Examples 1 and 2.

Example 4

In Examples 1 to 3, an example in which one ink tank 10 out of the plurality of ink tanks 10 is provided with the protruding container 101 is illustrated. The number of ink tanks 10 in which the protruding container 101 is provided is not limited to one. A configuration in which two ink tanks 10 out of the plurality of ink tanks 10 are each provided with the protruding container 101, and a configuration in which all the plurality of ink tanks 10 are each provided with the protruding container 101 can be adopted. That is, a configuration in which, at least one ink tank 10 out of the plurality of ink tanks 10 is arranged so as to extend across the region 73 outside the conveyance path 67 on the X axis direction side and the region that is overlapped with the conveyance path 67, when viewed in the −Z axis direction, can be adopted.

An example in which all of the plurality of ink tanks 10 are each provided with the protruding container 101 will be described as Example 4. In Example 4, constituent parts that are the same as those in Examples 1 to 3 and constituent parts that have functions similar to those in Examples 1 to 3 will be denoted by the same reference signs as in Examples 1 to 3, and will not be described in detail.

Figure 15:
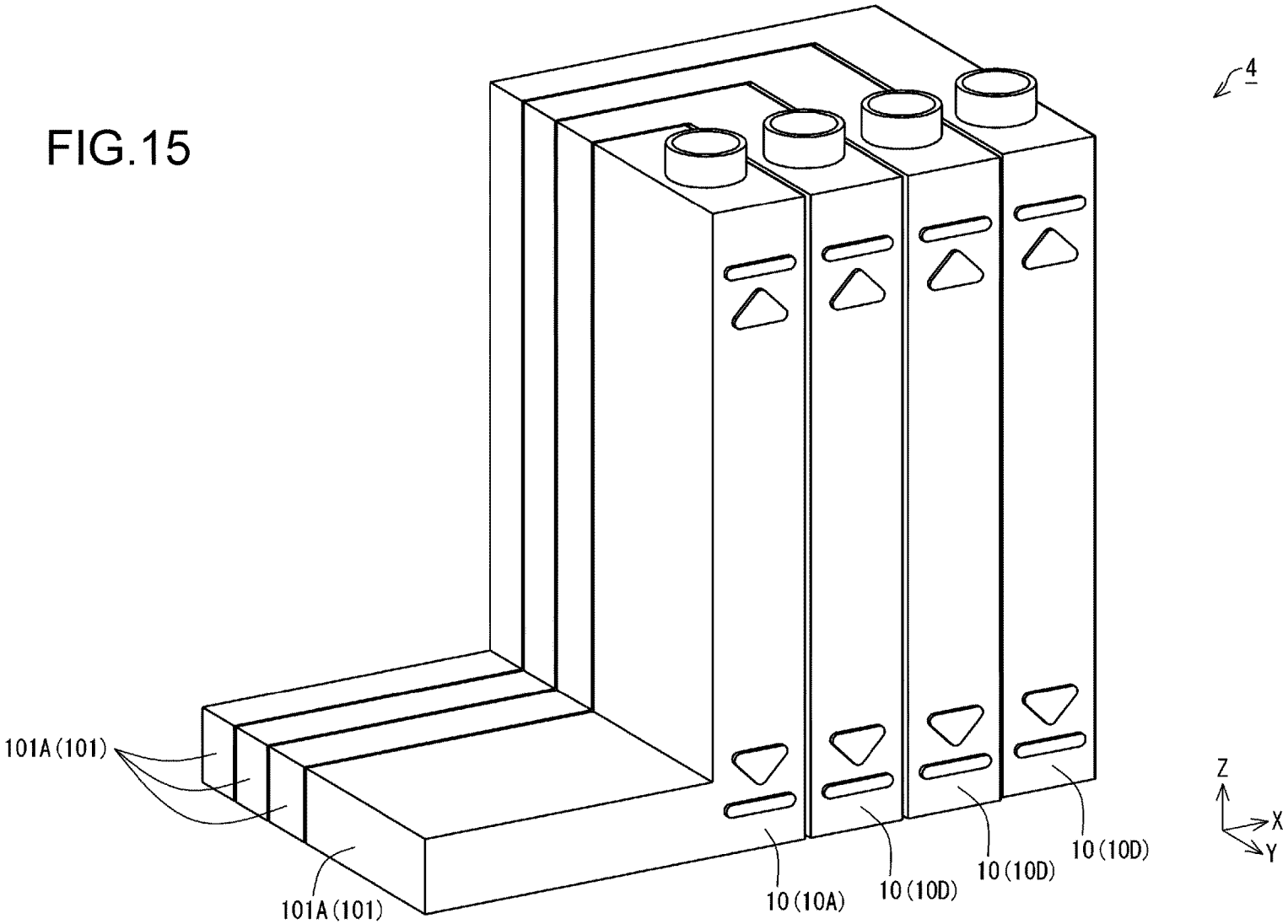
FIG. 15 is a perspective view illustrating a main configuration of a tank unit in Example 4.
Figure 16:
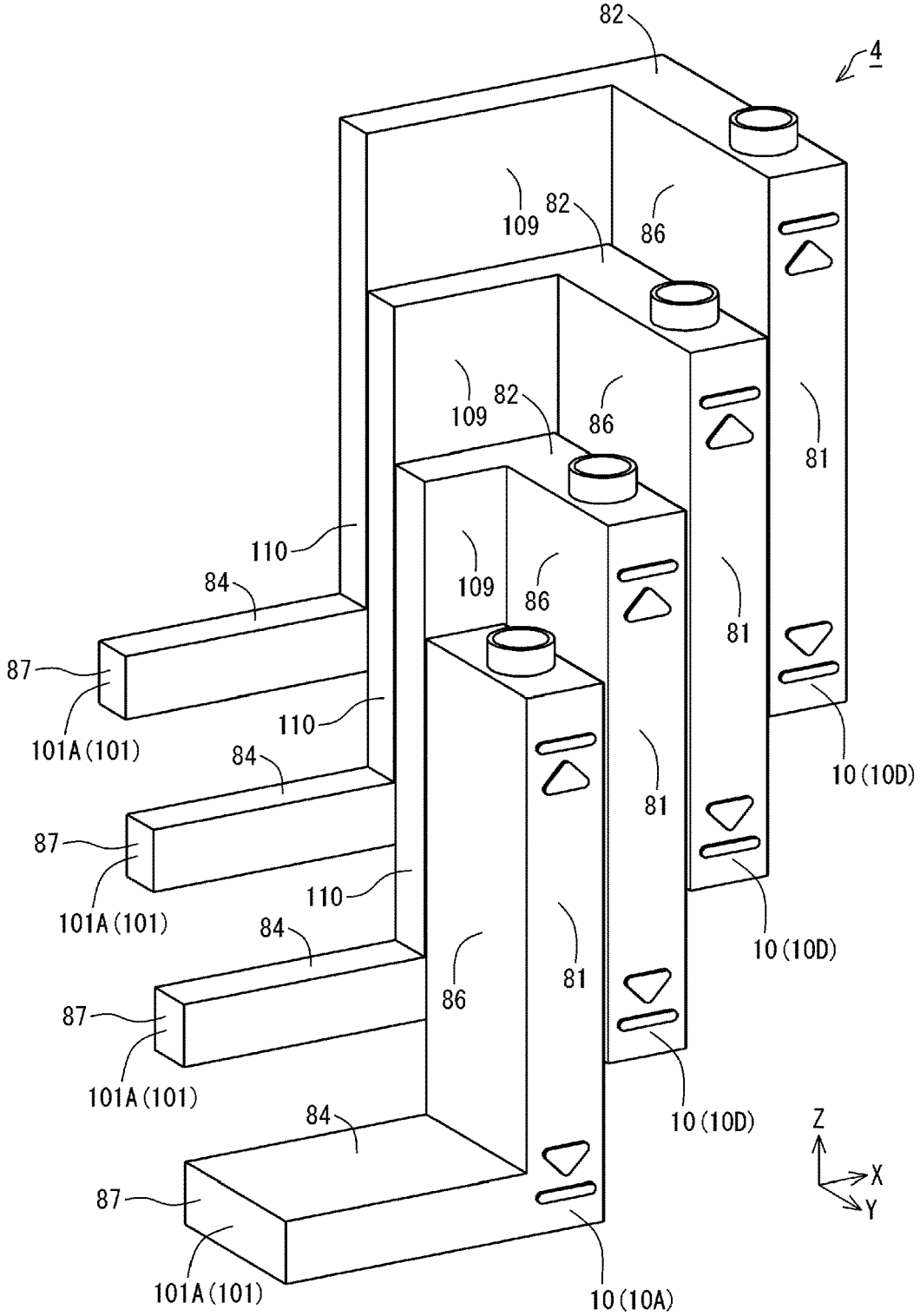
FIG. 16 is an exploded perspective view illustrating the main configuration of the tank unit in Example 4.

In the tank unit 4 in Example 4, the four ink tanks 10 are each provided with the protruding container 101A, as shown in FIG. 15. Three ink tanks 10D of the four ink tanks 10 excluding the ink tank 10A each include a ninth wall 109 and a tenth wall 110, as shown in FIG. 16. The ninth wall 109 is a wall that faces the Y axis direction. The ninth wall 109 is located on the −Y axis direction side relative to the first wall 81. The ninth wall 109 intersects the sixth wall 86 at an end portion thereof on the X axis direction side. Also, the ninth wall 109 intersects the second wall 82 at an end portion thereof on the Z axis direction side.

The tenth wall 110 is a wall that faces the −X axis direction. The tenth wall 110 is located on the −X axis direction side relative to the sixth wall 86. The tenth wall 110 intersects the ninth wall 109 at an end portion thereof on the Y axis direction side. Also, the tenth wall 110 intersects the second wall 82 at an end portion thereof on the Z axis direction side, and intersects the fourth wall 84 at an end portion thereof on the −Z axis direction side. According to the configuration described above, a level difference is formed between the sixth wall 86 and the tenth wall 110 in the ink tank 10D. An ink tank 10 adjacent thereto is arranged so as to fill the level difference. Accordingly, in Example 4, all of the ink tanks 10 can each be provided with the protruding container 101A while saving space. According to Example 4, at least one ink tank 10 out of the plurality of ink tanks 10 can be extended to a region that is overlapped with the conveyance path 67.

Example 5

Figure 17:
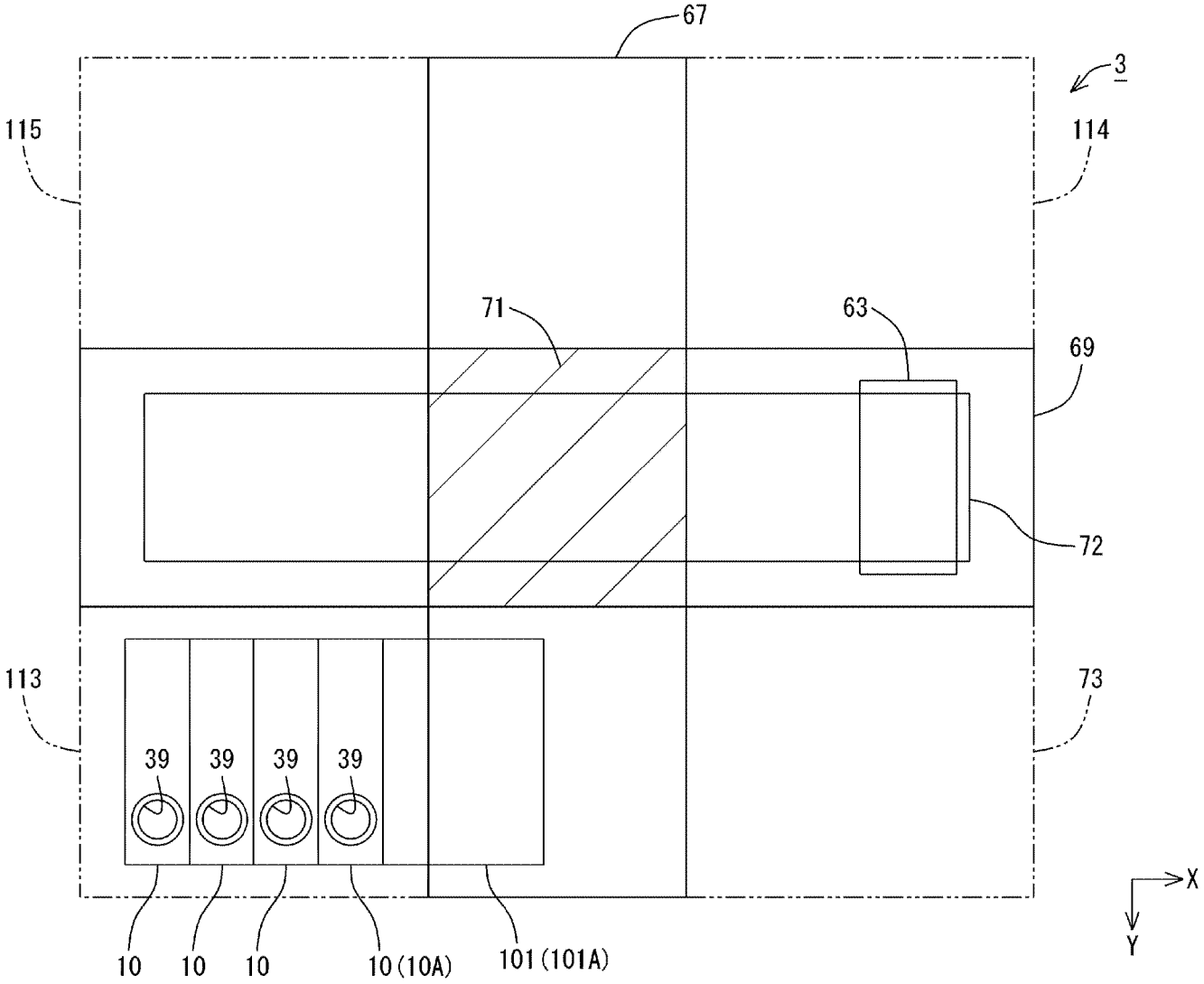
FIG. 17 is a plan view schematically illustrating a configuration of Example 5.

In Examples 1 to 4, the ink inlet ports 39 of the plurality of ink tanks 10 are arranged on the X axis direction side relative to the conveyance path 67, as shown in FIG. 8. However, the arrangement of the plurality of ink tanks 10 is not limited thereto. An example in which the ink inlet ports 39 are arranged on the −X axis direction side relative to the conveyance path 67, as shown in FIG. 17, can be adopted as the arrangement of the plurality of ink tanks 10 as well. An example in which, in each of Examples 1 to 4, the ink inlet ports 39 are arranged in a region 113 that is on the Y axis direction side relative to the movable region 69 and on the −X axis direction side relative to the conveyance path 67 is adopted as Example 5. In Example 5, at least one ink tank 10 out of the plurality of ink tanks 10 is arranged so as to extend across the region 113 and a region that is overlapped with the conveyance path 67.

In the present example, at least a portion of the protruding container 101 of the ink tank 10 that is arranged so as to extend across the region 113 and the region that is overlapped with the conveyance path 67 is overlapped with a region of the conveyance path 67. In the present example, any of the protruding container 101A in Example 1, the protruding container 101B in Example 2, and a combination of the protruding container 101A and the protruding container 101B can be adopted as the mode of the protruding container 101. That is, in Example 5 as well, any of a configuration in which the protruding container 101 is located below the conveyance path 67, a configuration in which the protruding container 101 is located above the conveyance path 67, and a configuration in which the protruding containers 101 are respectively located below and above the conveyance path 67 can be adopted. Example 5 can also achieve effects similar to those of Examples 1 to 4.

Example 6

An example in which, in Examples 1 to 4, the ink inlet ports 39 are arranged on the −Y axis direction side relative to the movable region 69 can be adopted as well. An example in which, in each of Examples 1 to 4, the ink inlet ports 39 are arranged in a region that is on the −Y axis direction side relative to the movable region 69 and on the X axis direction side relative to the conveyance path 67 is adopted as Example 6. The region that is on the −Y axis direction side relative to the movable region 69 and on the X axis direction side relative to the conveyance path 67 is denoted as a region 114, as shown in FIG. 17.

In Example 6 as well, any of a configuration in which the protruding container 101 is located below the conveyance path 67, a configuration in which the protruding container 101 is located above the conveyance path 67, and a configuration in which the protruding containers 101 are respectively located below and above the conveyance path 67 can be adopted. Example 6 can also achieve the effects similar to those of Examples 1 to 5.

Example 7

An example in which, in Example 5, the ink inlet ports 39 are arranged on the −Y axis direction side relative to the movable region 69 can be adopted as well. In other words, an example in which, in each of Examples 1 to 4, the ink inlet ports 39 are arranged in a region that is on the −Y axis direction side relative to the movable region 69 and on the −X axis direction side relative to the conveyance path 67 can be adopted as well. The region that is on the −Y axis direction side relative to the movable region 69 and on the −X axis direction side relative to the conveyance path 67 is denoted as a region 115, as shown in FIG. 17.

In Example 7 as well, any of a configuration in which the protruding container 101 is located below the conveyance path 67, a configuration in which the protruding container 101 is located above the conveyance path 67, and a configuration in which the protruding containers 101 are respectively located below and above the conveyance path 67 can be adopted. Example 7 can also achieve effects similar to those of Examples 1 to 6.

In each of the embodiments and examples described above, the liquid ejection device may be a liquid ejection device that consumes a liquid other than ink by ejecting, discharging, or applying the liquid. Note that the states of liquid discharged as very small droplets from the liquid ejection device includes a granular shape, a tear-drop shape, and a shape having a thread-like trailing end. Furthermore, the liquid mentioned here may be any kind of material that can be consumed by the liquid ejection device. For example, the liquid need only be a material whose substance is in the liquid phase, and includes fluids such as an inorganic solvent, an organic solvent, a solution, a liquid resin, and a liquid metal (metal melt) in the form of a liquid body having a high or low viscosity, a sol, gel water, or the like. Furthermore, the liquid is not limited to being a one-state substance, and also includes particles of a functional material made from solid matter, such as pigment or metal particles, that are dissolved, dispersed, or mixed in a solvent. Representative examples of the liquid include ink such as that described in the above embodiments, liquid crystal, or the like. Here, "ink" encompasses general water-based ink and oil-based ink, as well as various types of liquid compositions such as gel ink and hot melt-ink. Moreover, sublimation transfer ink can be used as the ink. Sublimation transfer ink is ink that includes a sublimation color material such as a sublimation dye. One example of a printing method is a method in which sublimation transfer ink is ejected onto a transfer medium by a liquid ejection device, a printing target is brought into contact with the transfer medium and heated to cause the color material to sublimate and be transferred to the printing target. The printing target is a T-shirt, a smartphone, or the like. In this way, if the ink includes a sublimation color material, printing can be performed on a diverse range of printing targets (printing media). Specific examples of the liquid ejection device include a liquid ejection device that ejects liquid including a material, such as an electrode material or a color material that is used for manufacturing a liquid crystal display, an EL (electro-luminescence) display, a surface emission display, or a color filter, for example, in the form of being dispersed or dissolved. The liquid ejection device may also be a liquid ejection device that ejects biological organic matter used in manufacturing of a biochip, a liquid ejection device that is used as a precision pipette and ejects a liquid serving as a sample, a textile printing apparatus, a microdispenser, or the like. Furthermore, the liquid ejection device may be a liquid ejection device that ejects lubricating oil in a pinpoint manner to a precision machine such as a watch or a camera, or a liquid ejection device that ejects, onto a substrate, transparent resin liquid such as UV-cured resin for forming, for example, a micro-hemispherical lens (optical lens) that is used in an optical communication element or the like. The liquid ejection device may also be a liquid ejection device that ejects acid or alkaline etchant, for example, for etching substrates or the like.

Note that the invention is not limited to the above embodiments and working examples, and can be achieved as various configurations without departing from the gist of the invention. For example, the technical features in the embodiments and working examples that correspond to the technical features in the modes described in the summary of the invention may be replaced or combined as appropriate in order to solve a part of, or the entire foregoing problem, or to achieve some or all of the above-described effects. The technical features that are not described as essential in the specification may be deleted as appropriate.

What is claimed is:

1. A printer comprising:

a printing head that can eject ink toward a printing medium;

an ink tank that includes an ink container configured to contain the ink that is to be supplied to the printing head and an ink inlet port through which the ink can be injected into the ink container;

a carriage in which the printing head is mounted and that can move back and forth in a state in which the printing head is mounted; and a medium conveyance device that conveys the printing medium on a conveyance path that intersects a moving direction of the carriage, wherein, when an axis line along the moving direction of the carriage is defined as an X axis, an axis line orthogonal to the X axis is defined as a Y axis and an axis line orthogonal to the X axis and the Y axis is defined as a Z axis, the ink tank, when viewed along the Z axis, is located in a region outside a movable region of the carriage along the Y axis, and is arranged so as to extend across a region outside the conveyance path along the X axis and a region that is overlapped with the conveyance path, and furthermore, the ink tank, when viewed along the Y axis, includes a part overlapped with the movable region of the carriage.

2. The printer according to claim 1, further comprising:

a discharge port from which the printing medium on which printing has been performed is discharged; and a cap configured and arranged to cover the printing head, wherein, when a direction from an intersection region in which the movable region of the carriage intersects the conveyance path toward the discharge port is defined as a +Y axis direction, and a direction from the intersection region toward the cap is defined as a +X axis direction, when viewed in a −Z axis direction defined as an ink ejection direction, the region that is outside the movable region of the carriage along the Y axis and is outside the conveyance path along the X axis is located on the +X axis direction side relative to the conveyance path and on the +Y axis direction side relative to the movable region of the carriage.

3. The printer according to claim 1, further comprising:

a discharge port from which the printing medium on which printing has been performed is discharged; and a cap configured and arranged to cover the printing head, wherein, when a direction from an intersection region in which the movable region of the carriage intersects the conveyance path toward the discharge port is defined as a +Y axis direction, and a direction from the intersection region toward the cap is defined as a +X axis direction, when viewed in a −Z axis direction defined as an ink ejection direction of the printing head, the region that is outside the movable region of the carriage along the Y axis and is outside the conveyance path along the X axis is located on a −X axis direction side relative to the conveyance path and on a +Y axis direction side relative to the movable region of the carriage.

4. The printer according to claim 1, further comprising:

a discharge port from which the printing medium on which printing has been performed is discharged; and a cap configured and arranged to cover the printing head, wherein, when a direction from an intersection region in which the movable region of the carriage intersects the conveyance path toward the discharge port is defined as a +Y axis direction, and a direction from the intersection region toward the cap is defined as a +X axis direction, when viewed in a −Z axis direction defined as an ink ejection direction of the printing head, the region that is outside the movable region of the carriage along the Y axis and is outside the conveyance path along the X axis is located on a +X axis direction side relative to the conveyance path and on a −Y axis direction side relative to the movable region of the carriage.

5. The printer according to claim 1, further comprising:

a discharge port from which the printing medium on which printing has been performed is discharged; and a cap that can cover the printing head, wherein, when a direction from an intersection region in which the movable region of the carriage intersects the conveyance path toward the discharge port is defined as a +Y axis direction, and a direction from the intersection region toward the cap is defined as a +X axis direction, when viewed in a −Z axis direction defined as an ink ejection direction of the printing head, the region that is outside the movable region of the carriage along the Y axis and is outside the conveyance path along the X axis is located on a −X axis direction side relative to the conveyance path and on a −Y axis direction side relative to the movable region of the carriage.

6. The printer according to claim 1, wherein, when an ink ejection direction of the printing head is defined as a −Z axis direction, and a direction opposite to the −Z direction is defined as a +Z axis direction, a portion of the ink tank that is located in a region that is overlapped with the conveyance path, when viewed in the −Z axis direction, is located on a +Z axis direction side relative to the conveyance path.

7. The printer according to claim 1, wherein, when an ink ejection direction of the printing head is defined as a −Z axis direction, and a direction opposite to the −Z axis direction is defined as a +Z axis direction, a portion of the ink tank that is located in a region that is overlapped with the conveyance path, when viewed in the −Z axis direction, is located on the −Z axis direction side relative to the conveyance path.

8. The printer according to claim 1, further comprising:

a plurality of the ink tanks, wherein at least one ink tank out of the plurality of ink tanks is arranged so as to extend across a region outside the conveyance path along the X axis and a region that is overlapped with the conveyance path, when viewed along the Z axis.

* * * * *